US005870022A

United States Patent [19]

Kuhnly et al.

[11] Patent Number: 5,870,022

[45] Date of Patent: Feb. 9, 1999

[54] PASSIVE INFRARED DETECTION SYSTEM AND METHOD WITH ADAPTIVE THRESHOLD AND ADAPTIVE SAMPLING

[75] Inventors: Keith D. Kuhnly, Lino Lakes; Paul G. Saldin, Oakdale, both of Minn.

[73] Assignee: Interactive Technologies, Inc., North St. Paul, Minn.

[21] Appl. No.: 941,856

[22] Filed: Sep. 30, 1997

[51] Int. Cl.[6] ..... G08B 13/18

[52] U.S. Cl. ..... 340/567; 340/511; 340/522

[58] Field of Search ..... 340/567, 584, 340/511, 521, 522, 541, 552, 693

[56] References Cited

U.S. PATENT DOCUMENTS

| | | | |
|---|---|---|---|
| 3,760,399 | 9/1973 | Schwarz | 340/258 D |
| 3,928,843 | 12/1975 | Sprout et al. | 340/258 D |
| 4,179,691 | 12/1979 | Keller | 340/567 |
| 4,181,060 | 1/1980 | Payne | 85/64 |
| 4,209,783 | 6/1980 | Ohyama et al. | 340/152 T |
| 4,260,981 | 4/1981 | Yamauchi et al. | 340/870.11 |
| 4,318,089 | 3/1982 | Frankel et al. | 340/567 |
| 4,437,089 | 3/1984 | Achard | 340/541 |
| 4,468,658 | 8/1984 | Rossin | 340/567 |
| 4,521,768 | 6/1985 | Haran et al. | 340/566 |
| 4,543,567 | 9/1985 | Shirata et al. | 340/519 |
| 4,551,711 | 11/1985 | Akiyama et al. | 340/567 |
| 4,562,548 | 12/1985 | Andersen et al. | 364/483 |
| 4,570,157 | 2/1986 | Kodaira | 340/567 |
| 4,612,442 | 9/1986 | Toshimichi | 250/353 |
| 4,618,854 | 10/1986 | Miyake et al. | 340/567 |
| 4,636,774 | 1/1987 | Galvin et al. | 340/565 |
| 4,743,886 | 5/1988 | Steiner et al. | 340/514 |
| 4,745,284 | 5/1988 | Masuda et al. | 250/338.3 |
| 4,746,691 | 5/1988 | Fuhrman | 524/40 |
| 4,746,910 | 5/1988 | Pfister et al. | 340/567 |
| 4,764,755 | 8/1988 | Pedtke et al. | 340/541 |
| 4,769,545 | 9/1988 | Fraden | 250/353 |
| 4,875,029 | 10/1989 | Guscott et al. | 340/567 |
| 4,896,039 | 1/1990 | Fraden | 340/567 X |
| 4,912,748 | 3/1990 | Horii et al. | 250/221 |
| 4,942,384 | 7/1990 | Yamauchi et al. | 340/522 |
| 4,949,074 | 8/1990 | D'Ambrosia et al. | 340/552 |
| 4,999,610 | 3/1991 | Guscott | 340/567 |
| 5,017,906 | 5/1991 | Pantus | 340/517 |
| 5,077,549 | 12/1991 | Hershkovitz et al. | 340/567 |
| 5,084,696 | 1/1992 | Guscott et al. | 340/541 |
| 5,151,682 | 9/1992 | Marinitsch | 340/514 |

(List continued on next page.)

OTHER PUBLICATIONS

C&K Systems, IntelliSense Installation Instructions, Models MC–500, MC–550T Microcontroller Based Passive Infrared Motion Sensor (1996).

Crow Electronic Engineering Ltd., Lynx–T High Performance (ASIC Technology) Passive Infrared Detectors, Installation Instructions P/N: 7101118.

Crow Electronic Engineering Ltd., MH10 Passive Infrared Instrusion Detector, P/N: 7101004.

*Primary Examiner*—Thomas J. Mullen, Jr.
*Attorney, Agent, or Firm*—Fish & Richardson P.C., P.A.

[57] ABSTRACT

A detection system and method are capable of reducing the occurrence of false alarms and detection failures by compensating for variations in the amplitude of a detection signal generated by a PIR sensor. An adaptive threshold can be used that varies according to ambient temperature of the detection area and the frequency of the detection signal. Comparison of the detection signal to the adaptive threshold allows compensation for temperature- and/or frequency-induced variations in detection signal amplitude. The adaptive threshold can be configured for standard detection area conditions or calibrated for conditions at the installation site. Relative measurement and adaptive sampling techniques also can be used to compensate for the presence of low frequency shifts in the detection signal. Such techniques can provide an accurate representation of signal amplitude relative to a threshold amplitude despite differences in absolute signal magnitude. The use of an adaptive sampling rate that increases with the onset of a potential intruder event contributes to power conservation in the detector.

5 Claims, 25 Drawing Sheets

U.S. PATENT DOCUMENTS

| | | | |
|---|---|---|---|
| 5,168,262 | 12/1992 | Okayama | 340/523 |
| 5,276,427 | 1/1994 | Peterson | 340/522 |
| 5,309,147 | 5/1994 | Lee et al. | 340/567 |
| 5,312,620 | 5/1994 | Ribi | 424/78.31 |
| 5,317,620 | 5/1994 | Smith | 379/40 |
| 5,331,308 | 7/1994 | Buccola et al. | 340/522 |
| 5,369,269 | 11/1994 | Fukuda et al. | 250/221 |
| 5,382,944 | 1/1995 | Dipoala et al. | 340/567 |
| 5,394,035 | 2/1995 | Elwell | 327/72 |
| 5,414,263 | 5/1995 | Haslam et al. | 250/338.1 |
| 5,444,431 | 8/1995 | Kenny | 340/541 |
| 5,444,432 | 8/1995 | Pildner et al. | 340/567 |
| 5,453,733 | 9/1995 | Peterson et al. | 340/567 |
| 5,471,194 | 11/1995 | Guscott | 340/511 |
| 5,473,311 | 12/1995 | Hoseit | 340/573 |
| 5,483,222 | 1/1996 | Tice | 340/518 |
| 5,493,273 | 2/1996 | Smurlo et al. | 340/541 |
| 5,504,473 | 4/1996 | Cecic et al. | 340/541 |
| 5,629,676 | 5/1997 | Kartoun et al. | 340/567 |

110

| Buffer | |
|---|---|
| $B_0$ | $M_0$ |
| $B_1$ | $t_0$ |
| $B_2$ | $t_{01}$ |
| $B_3$ | $M_1$ |
| $B_4$ | $t_1$ |
| $B_5$ | $t_{12}$ |
| $B_6$ | $M_2$ |

PASSIVE INFRARED DETECTION SYSTEM AND METHOD WITH ADAPTIVE THRESHOLD AND ADAPTIVE SAMPLING

FIELD OF THE INVENTION

The present invention relates to intruder detection systems and methods employing passive infrared (PIR) sensors.

BACKGROUND OF THE INVENTION

Intruder detection systems for home or commercial security applications often employ PIR sensors to detect the movement of heat-emitting objects within a detection area. A PIR sensor typically includes a pair of heat sensor elements. Each of the heat sensor elements comprises a pyroelectric material, or other radiation sensitive material, that generates electric charge in response to incident infrared radiation. The heat sensor elements generate oppositely poled signals. The PIR sensor includes a fresnel lens that defines the field of view of the sensor elements. The fresnel lens includes an array of sub-lenses that divides the detection area into a plurality of detection zones. The sub-lenses focus infrared radiation from each of the detection zones onto the heat sensor elements. Each of the heat sensor elements generates a signal representative of the incident infrared radiation. The PIR sensor sums the oppositely poled sensor element signals to produce a detection signal.

Signal processing circuitry associated with the PIR sensor receives the detection signal and performs appropriate amplification and filtering for presentation of the signal to a comparator circuit. The detection signal represents the difference between heat emitted by an intruder and background heat emission. If no intruder is present, the signals generated by both of the heat sensor elements will represent background heat emission and generally cancel out one another when summed. As a result, the detection signal will tend toward zero, or at least some base-line level, when no intruder is present.

As a heat-emitting object crosses from one zone to another, the amount of heat radiation received by the sensor elements will vary. In particular, boundaries between zones created by the sub-lenses will block portions of the infrared radiation emitted by the object. The sensor elements are spatially displaced relative to one another. Thus, as the object moves and interacts with zone boundaries, the sensor elements will receive radiation from a given zone in a temporally displaced manner. The summed detection signal therefore will rise and fall, taking on an alternating waveform. The frequency of the waveform is a function of the velocity of the object across the zones and the distance of the object from the sensor elements. The rise and fall of the detection signal provides an indication of movement within the detection area, whereas the amplitude of the signal gives an indication of its significance, i.e., whether the signal is indicative of a heat-emitting object that qualifies as an intruder.

To determine the significance of the detection signal, a comparator circuit is provided to compare the signal to a predetermined threshold. The threshold may take the form of a window having upper and lower thresholds. Upon a signal excursion outside of the window, i.e., above the upper threshold or below the lower threshold, a window comparator generates a signal indicative of the presence of an intruder. The detection system then initiates a response such as the activation of an alarm and/or the dispatch of security personnel.

The avoidance of false alarms is a concern in any detection system. Also important is the ability to detect the presence of an intruder under a variety of conditions. Due to a number of variations, however, the comparison of the signal to a predetermined threshold can result in false alarms or the failure to detect intruders. Such variations include changes in environmental conditions existing in the detection area, various features of an object entering the detection area, varying characteristics of the signal processing circuitry, or a combination of the above factors.

As an example, the detection signal can vary in amplitude as a function of intruder emission relative to an ambient temperature existing in the detection area. Specifically, as the ambient temperature varies, the background heat emission similarly varies. The result is a variation in the amplitude of the intruder detection signal. As the ambient temperature approaches human body temperature the difference in temperature between background and an intruder will decrease. Consequently, the amplitude of the detection signal decreases significantly. If the threshold window is set too wide, the signal processing circuitry may fail to resolve the presence of an intruder at ambient temperatures producing smaller signal amplitudes. If the threshold window is set too narrow, however, the vulnerability of the system to false alarms increases.

The detection signal also varies as a function of the frequency of the detection signal, and thus the velocity of an object within the detection area. As the velocity of an object increases, the amplitude of the detection signal tends to decrease. When the detection signal is compared to a threshold, variations in the signal amplitude due to the velocity of an object in the detection area can result in false alarms or detection failure.

Another variation in the amplitude of the detection signal that can lead to false alarms or detection failure is the introduction of a slow ac rise or fall. Specifically, over time, the detection signal can acquire a significant, but slowly changing, increase or decrease due to factors such as changes in ambient temperature or prolonged presence of an intruder within one or more zones. The increase or decrease tends to shift the magnitude of the signal. Although the output of PIR sensor typically will be ac-coupled to a signal processing circuit, the resulting rise or fall may have the local effect of a dc offset. With such a shift, a detection signal that otherwise would not be indicative of the presence of an intruder may extend outside of a given threshold window. As a result, the detection system may register a false alarm. With a shift causing the signal to fall inside of one of the window thresholds, the detection system may fail to detect the presence of an intruder.

SUMMARY OF THE INVENTION

In view of the foregoing problems associated with existing PIR-based detection systems, i.e., false alarms and detection failure due to variations in the amplitude of the detection signal, there is a need for an improved detection system.

The present invention is directed to a system and method for processing signals generated by a PIR sensor in an intruder detection system. A system or method in accordance with the present invention is capable of reducing the occurrence of false alarms and detection failures by compensating for variations in the amplitude of a detection signal generated by a PIR sensor.

For example, an adaptive threshold may be provided that varies according to ambient temperature and detection signal frequency. Comparison of the detection signal to the adaptive threshold allows compensation for temperature- and/or frequency-induced variations in detection signal amplitude. In this manner, the effects of such amplitude variations in producing false alarms or compromising detection effectiveness can be mitigated.

The adaptive threshold can be configured for standard detection area conditions. If desired, however, the adaptive threshold can be calibrated according to temperature and frequency variations existing in a particular detection area. In this manner, a detection system can, in effect, be tuned for the unique characteristics of a detection area.

The calibration can be comprehensive in scope, involving the measurement of detection signal amplitudes for a wide expanse of temperatures and frequencies. Alternatively, calibration may involve a "recalibration" in which a smaller number of measurements are taken, and adjustments are made to the adaptive threshold.

Further, relative measurement techniques and adaptive sampling may be used to compensate for the presence of a shift in the detection signal due to factors such as temperature change or prolonged intruder presence. Relative measurement techniques, such as peak-to-reference and peak-to-peak measurements, can provide an accurate representation of signal amplitude relative to a threshold amplitude despite differences in absolute magnitude caused by signal shifts. Adaptive sampling enables the use of relative measurement techniques despite sudden, anomalous changes in the detection signal. In particular, adaptive sampling allows selective sampling and retention of portions of the detection signal to effectively filter out relatively high frequency changes causing signal slope changes that otherwise would compromise the relative measurement techniques.

With the use of adaptive thresholds, relative measurement techniques, and adaptive sampling, it is possible to avoid false alarms that otherwise could arise due to temperature variations, frequency variations, slow signal shifts, or sudden changes. It is also possible to more effectively detect the presence of an intruder. Thus, an overall advantage of a system or method constructed according to the present invention is a reduction in false alarms and detection failures, resulting in more efficient use of emergency response resources and enhanced security.

In one embodiment, the present invention relates to a detection system and method that can be configured to receive, via a passive infrared sensor, a detection signal indicative of a level of infrared radiation within a detection area, generate a temperature signal indicative of a temperature of the detection area, determine a value of the detection signal, determine a frequency of the detection signal, select one of a plurality of threshold values based on the frequency of the detection signal and the temperature indicated by the temperature signal, compare the value of the detection signal to the selected threshold value, and generate, in the event the value of the detection signal is greater than the selected threshold value, a signal indicative of presence of an object within the detection area.

In another embodiment, the present invention relates to a detection system and method that can be configured to receive, from a passive infrared sensor, a detection signal indicative of a level of infrared radiation within a detection area, determine a peak-to-peak amplitude of the detection signal, compare the peak-to-peak amplitude of the detection signal to a threshold amplitude, and indicate presence of an object within the detection area in the event the peak-to-peak amplitude is greater than the threshold amplitude.

In a further embodiment, the present invention relates to a detection system and method that can be configured to receive, from a passive infrared sensor, a detection signal indicative of a level of infrared radiation within a detection area, determine a peak-to-reference amplitude of the detection signal, determine a peak-to-peak amplitude of the detection signal, compare the peak-to-reference amplitude to a first threshold amplitude, compare the peak-to-peak amplitude of the detection signal to a second threshold amplitude greater than the first threshold amplitude, and indicate, in the event the peak-to-reference amplitude is greater than the first threshold amplitude and the peak-to-peak amplitude is greater than the second threshold amplitude, presence of the object within the detection area.

In another embodiment, the present invention relative to a method for calibrating a detection system that includes the steps of receiving a detection signal from a passive infrared sensor, the detection signal being indicative of infrared radiation within a detection area, measuring the values of the detection signal for one or more different conditions within the detection area, and generating a plurality of threshold values based on the measured values, wherein each of the threshold values represents a value of the detection signal indicative of presence of an intruder within the detection area for a particular combination of the different conditions.

In another embodiment, the present invention provides a detection system comprising a passive infrared sensor for generating a detection signal indicative of a level of infrared radiation within a detection area, a processor operatively coupled to receive the detection signal from the infrared sensor, wherein the processor is programmed to execute the steps of acquiring a plurality of samples of the detection signal representative of slope changes in the detection signal, analyzing absolute differences between the values of successive samples to identify those samples representative of noise-induced slope changes in the detection signal, discarding the identified samples, and comparing the absolute differences between the values of successive remaining samples to a threshold value, indicating, in the event one or more the absolute differences exceeds the threshold value, a condition potentially indicative of the presence of an intruder within the detection area.

In another embodiment, the present invention provides a detection system comprising a passive infrared sensor for generating a detection signal indicative of a level of infrared radiation within a detection area, and a processor coupled to receive the detection signal and the temperature signal, wherein the processor is programmed to execute the steps of determining a value of the detection signal, determining a frequency of the detection signal, selecting one of a plurality of threshold values based on the frequency of the detection signal, comparing the value of the detection signal to the selected threshold value, and generating, in the event the value of the detection signal is greater than the selected threshold value, a signal indicative of presence of an intruder within the detection area.

In another embodiment, the present invention provides a detection system comprising a passive infrared sensor for generating a detection signal indicative of a level of infrared radiation within a detection area, a temperature sensor for generating a temperature signal indicative of a temperature of the detection area, and a processor coupled to receive the detection signal and the temperature signal, wherein the processor is programmed to execute the steps of determining a value of the detection signal, selecting one of a plurality of threshold values based on the temperature indicated by the temperature signal, comparing the value of the detection signal to the selected threshold value, and generating, in the event the value of the detection signal is greater than the selected threshold value, a signal indicative of presence of an intruder within the detection area.

Other advantages, features, and embodiments of the present invention will become apparent from the following detailed description and claims.

DETAILED DESCRIPTION

Figure 1:
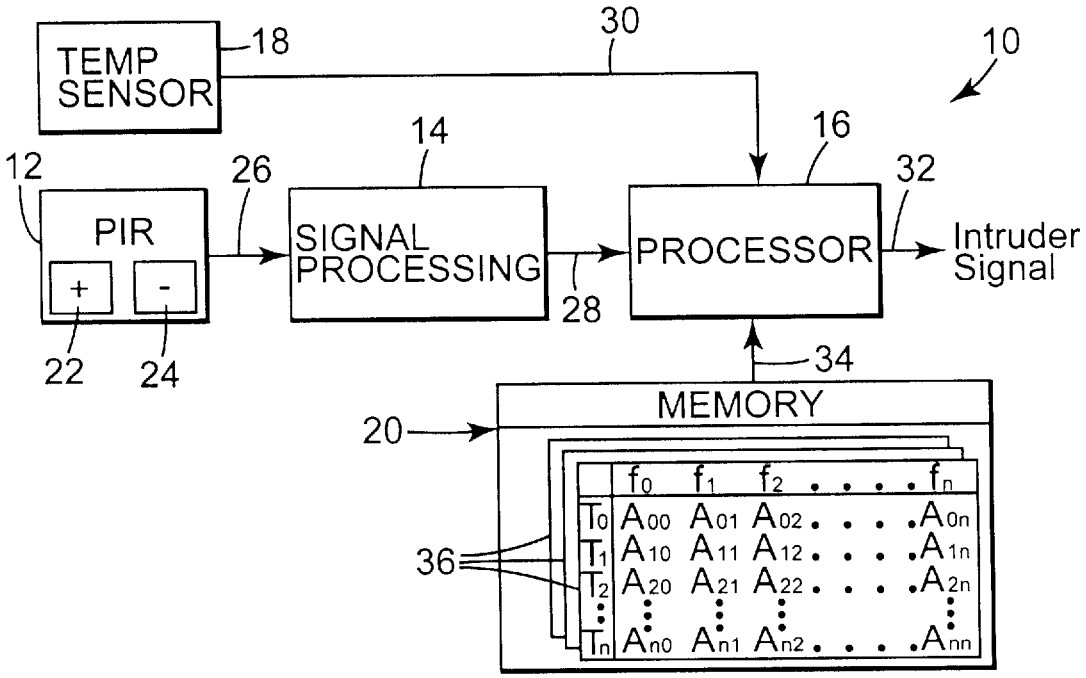
FIG. 1 is a functional block diagram of a detection system.

FIG. 1 is a functional block diagram illustrating a detection system 10, in accordance with an embodiment of the present invention. System 10 is capable of reducing the occurrence of false alarms and detection failures by the use of an adaptive threshold. As shown in FIG. 1, system 10 includes a passive infrared (PIR) sensor 12, a signal processing circuit 14, a processor 16, a temperature sensor 18, and a memory 20. PIR sensor 12, circuit 14, processor 16, temperature sensor 18, and memory 20 can be housed together within a common PIR-based detector module (not shown) and electrically coupled via a common circuit board (not shown).

PIR sensor 12 can be realized by any of a variety of commercially available PIR sensors. PIR sensor 12 includes a pair of sensor elements 22, 24. A lens assembly (not shown) such as a fresnel lens is mounted over sensor elements 22, 24 to define the field of view of PIR sensor 12 within a detection area. Specifically, the lens assembly is configured to focus infrared radiation from the detection area on sensor elements 22, 24. The lens assembly focuses the radiation via an array of sub-lenses that divides the detection area into a plurality of zones.

In response to incident infrared radiation, sensor elements 22, 24 generate oppositely poled signals. PIR sensor 12 sums the signals from sensor elements 22, 24 to generate a detection signal indicative of the level of infrared radiation within the detection area. If no intruder is present, the signals generated by both of sensor elements 22, 24 will generally cancel out one another when summed. Sensor elements 22, 24 are spatially displaced relative to one another. Thus, as a heat-emitting object moves and interacts with zone boundaries, sensor elements 22, 24 will receive radiation from a given zone in a temporally displaced manner. Consequently, the detection signal will rise and fall, taking on an alternating waveform. The frequency of the waveform is a function of the velocity of the intruder across the zone boundaries and the distance of the object from sensor elements 22, 24.

Signal processing circuit 14 receives the detection signal from PIR sensor 12, as indicated by line 26. Signal processing circuit 14 amplifies and filters the detection signal for transmission to processor 16, as indicated by line 28. However, signal processing circuit 14 need not be configured to compensate the detection signal for variations in amplitude due to temperature and/or frequency. Instead, this can be accomplished by appropriate configuration of processor 16 and memory 20, as will be explained in greater detail below.

Temperature sensor 18 generates a temperature signal indicative of an ambient temperature within the detection area. Processor 16 receives the temperature signal from temperature sensor 18, as indicated by line 30. Processor 16 may store data representative of the temperature signal at least temporarily in an area of memory 20. The temperature sensor 18 may be any of a variety of different temperature transducers such a thermistor or thermocouple. In particular, temperature sensor 18 can be realized by a thermistor coupled within signal processing circuit 14. The temperature signal enables system 10 to monitor changes in ambient temperature for purposes of selecting an adaptive threshold, in accordance with the present invention.

Processor 16 represents a programmable logic circuit suitable for processing the detection signal to generate an intruder detection signal. Processor 16 may be realized by an embedded microprocessor with associated memory including random access memory (RAM) for data manipulation and general program execution, and read-only memory (ROM) or EEPROM for program and data storage. Memory 20 will be referred to in general terms as providing general storage functions, including RAM and ROM, with the understanding that such storage may be realized by a collection of discrete memory devices accessed by processor 16, as necessary for operation.

In operation, processor 16 compares a value of the detection signal to a threshold value. For example, processor 16 may compare a magnitude of the signal to a threshold magnitude. It is preferred, however, that an amplitude of the detection signal be compared to a threshold amplitude. If the detection signal amplitude exceeds the threshold amplitude, processor 16 generates a signal indicating the presence of an intruder, as indicated by line 32. In accordance with the first embodiment of the present invention, however, processor 16 does not compare the detection signal to a static threshold. Instead, processor 16 makes use of an adaptive threshold that adapts to variations in the detection area that could cause false alarms or detection failures. Consequently, it is possible to avoid at least some of the false alarms and detection failures that otherwise could result from the use of a static threshold. This threshold can be adapted, for example, to variations in the temperature of the detection area and/or the frequency of the detection signal.

Figure 2:
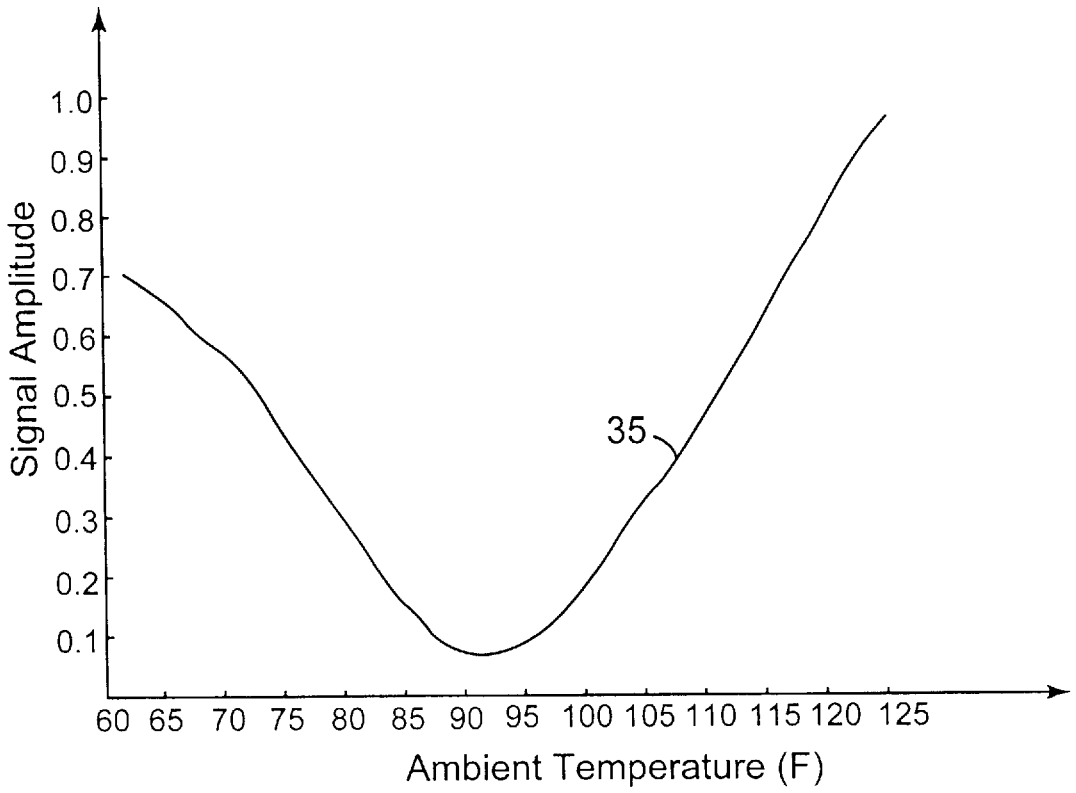
FIG. 2 is a graph illustrating variation in detection signal amplitude as a function of temperature.

FIG. 2 is a graph conceptually illustrating variation in detection signal amplitude as a function of temperature. As shown in FIG. 2, the amplitude of a detection signal 35 in the presence of an intruder generally varies with the ambient temperature of the detection area. This variation is a function of the difference between the temperature of an intruder and the ambient temperature. In particular, in the presence of an intruder, the amplitude of detection signal 35 tends toward a minimum value as the ambient temperature approaches human body temperature. In other words, the amplitude of detection signal 35 decreases as the difference between the temperature of the intruder and the ambient temperature decreases. As the ambient temperature tends away from intruder body temperature, however, the amplitude of detection signal 35 increases. This increase in amplitude corresponds to the increased difference between ambient temperature and intruder body temperature.

Figure 3:
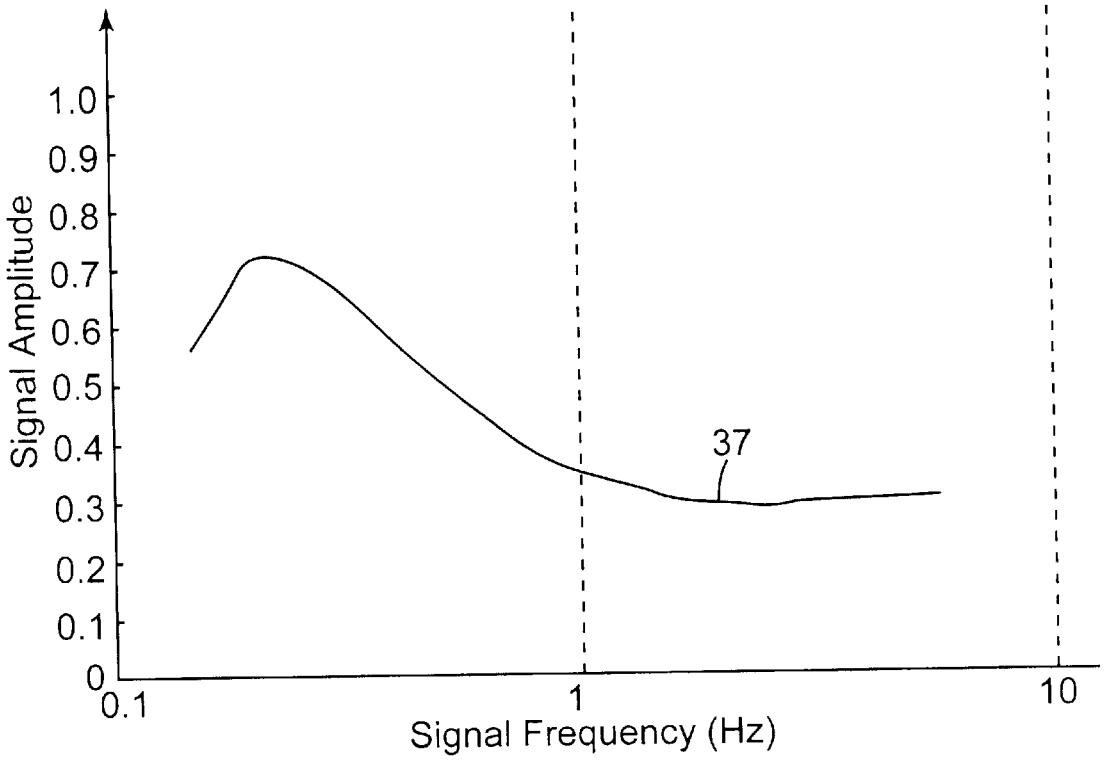
FIG. 3 is a graph illustrating variation in detection signal amplitude as a function of signal frequency.

FIG. 3 is a graph conceptually illustrating variation in detection signal amplitude as a function of signal frequency. The amplitude of detection signal 37 varies with the velocity and distance of an intruder, which is indicated by the frequency of the signal. With reference to FIG. 3, as the velocity of an intruder increases, the amplitude of detection signal 37 decreases. With a human intruder, the frequency of detection signal 37 generally falls in the range of 0.1 to 10 Hz. As shown in FIG. 3, the amplitude of detection signal 37 generally increases as signal frequency decreases within that range.

To compensate for temperature- and/or frequency-induced amplitude variations as illustrated in FIGS. 2 and 3, processor 16 accesses memory 20, as indicated by line 34, to select one of a plurality of threshold amplitudes based on the temperature and frequency determined for a particular detection signal. As shown in FIG. 1, memory 20 may store one or more threshold amplitude profiles 36. Each of profiles 36 provides a range of threshold amplitudes $A_0$–$A_n$ for a range of temperatures $T_0$–$T_n$ and frequencies $f_0$–$f_n$. Accordingly, profiles 36 together may be stored in memory 20 and accessed by processor 16 as two-dimensional lookup tables. By selecting an appropriate threshold amplitude for each detection signal, processor 16 provides an adaptive threshold amplitude.

A threshold amplitude $A_0$–$A_n$ conceivably could be provided in memory 20 for each temperature in units of degrees (Celsius or Fahrenheit) and each frequency in units of hertz. To reduce the amount of memory space and measurements required for thresholds $A_0$–$A_n$, however, the temperatures $T_0$–$T_n$ and frequencies $f_0$–$f_n$ can be divided into respective ranges. The selection of the temperature and frequency ranges will be subject to designer discretion based on the particular conditions existing for a given application, as well as the characteristics of PIR sensor 12. These ranges can be selected, however, such that variation in detection signal amplitude for temperatures and frequencies within those ranges is not excessive relative to an associated threshold amplitude $A_0$–$A_n$ to which the signal amplitude will be compared. In other words, it is desirable that the threshold amplitude $A_0$–$A_n$ for a particular combination of temperature and frequency ranges remain relevant, i.e., an effective measure of intruder presence, for all detection signal amplitudes produced with temperatures and frequencies within those ranges. In addition, the ranges may be continuous or include values taken from different areas of the temperature or frequency band, as applicable, provided such values are known or predicted to dictate common threshold amplitudes $A_0$–$A_n$.

Figure 4:
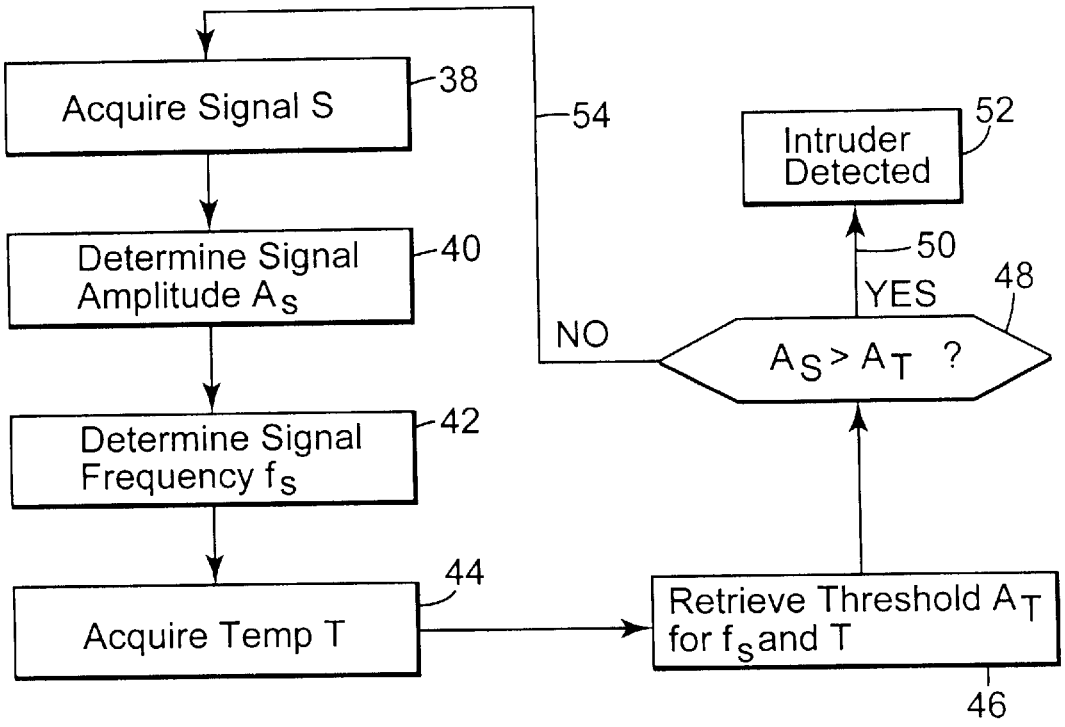
FIG. 4 is a flow diagram illustrating the operation of the detection system of FIG. 1 according to one embodiment of the present invention.

FIG. 4 is a flow diagram illustrating the operation of a system and method in accordance with this embodiment of the present invention. The operation will be described for purposes of illustration with respect to the structure and functionality of detection system 10. For detection of an intruder, processor 16 is programmed to first acquire a detection signal S from PIR sensor 12 via signal processing circuit 14, as indicated by block 38. Processor 16 is further programmed to determine both an amplitude $A_s$ and frequency $f_s$ of the detection signal, as indicated by blocks 40 and 42, respectively. It is noted that processor 16 typically will sample the detection signal S generated by PIR sensor 12 on a continuing basis over a series of sampling periods. Thus, it should be apparent that processor 16 determines the amplitude $A_s$ and frequency $f_s$ for a detection signal S acquired during a given sampling period.

Processor 16 preferably is programmed to determine the frequency $f_s$ of the signal in a manner that will be described in greater detail with respect to a second embodiment of the present invention. In summary, however, processor 16 may determine frequency by, for example, detecting changes in the slope of the detection signal during over a period of time. According to this approach, processor 16 can be programmed to determine the frequency based on the time elapsed between slope changes in the detection signal over the period.

According to this embodiment, the amplitude of the detection signal may be determined by processor 16 as an absolute magnitude. It may be desirable, however, to measure a peak-to-peak amplitude of the detection signal in order to compensate for magnitude variations due to low frequency signal shifts, as described in detail later in the description with respect to further embodiments of the present invention. In either case, the threshold amplitude should be selected as appropriate for the type of measurement used to represent detection signal value, i.e., magnitude or amplitude.

Processor 16 acquires a temperature T of the detection area, as indicated by block 44, from the temperature signal received from temperature sensor 18 or by reference to a stored value representative of the temperature signal acquired previously. Based on the determined frequency $f_i$ of the detection signal and the temperature $T_j$ indicated by the temperature signal, processor 16 selects and retrieves from memory 20 a threshold amplitude $A_T$ by accessing the appropriate entry within a selected profile 36, as indicated by block 46. Processor 16 then compares the detection signal amplitude $A_s$ to the selected threshold amplitude $A_T$, as indicated by block 48. If the detection signal amplitude $A_s$ exceeds the selected threshold amplitude, as indicated by line 50, processor 16 generates a signal indicative of the presence of an intruder, as indicated by block 52. The signal may provide a basis for generation of an alarm or dispatch of security personnel.

If the detection signal S does not exceed the selected threshold amplitude, as indicated by line 54, processor 16 acquires the next detection signal from PIR sensor 12. In this case, processor 16 again determines the frequency of the next detection signal, receives the current temperature signal from temperature sensor 18 or from memory, and selects an appropriate entry within a selected profile 36 from memory 20. According to a further embodiment of the invention, processor 16 also temporarily retains the previously acquired samples of the detection signal in an area of memory 20 for comparison to the next acquired signal, as will be described in greater detail. Thus, processor 16 repeats this adaptive process, thereby adapting the threshold during the course of detection to changing conditions. In this manner, system 10 provides a significant advantage in reducing susceptibility to the problems of false alarms and detection failure.

As an alternative to selecting a threshold amplitude for each sampled detection signal, processor 16 conceivably can be configured to cache an entry from profile 36 obtained for the previously sampled detection signal in an area of memory 20 set aside for quick access. Thus, the cached entry may serve as a default threshold amplitude until a significant change in frequency or temperature is determined for a subsequently sampled signal. The use of a cached threshold amplitude may be particularly desirable if the temperatures and frequencies are divided into zones having areas of moderate continuous breadth. In this case, insignificant changes in temperature or frequency may nevertheless fall within the same zones as for a previous signal. Consequently, the cached threshold amplitude may continue to be relevant for the signal under consideration, and again can be used for comparison. As another alternative, instead of caching an entry, the memory address for the entry may be cached.

Figure 5:
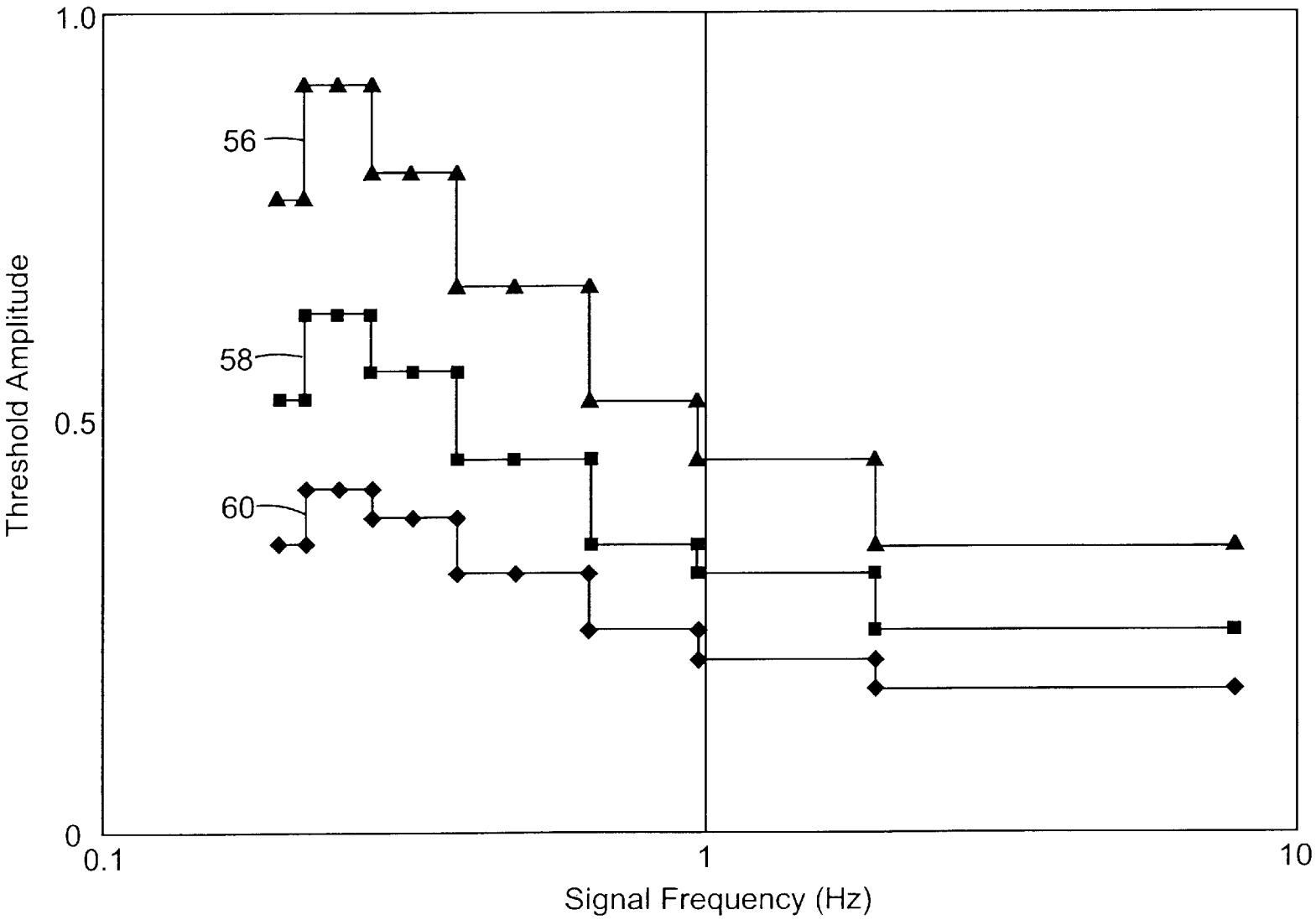
FIG. 5 is a graph illustrating the use of an adaptive sensor threshold.

FIG. 5 is a graph illustrating the use of the adaptive sensor threshold contemplated by one embodiment of the present invention. The graph of FIG. 5 provides an exemplary plot of threshold amplitude versus detection signal frequency over a plurality of temperature zones indicated by curves 56, 58, 60. Hence, this plot provides an example of the contents of the profiles 36 stored in memory 20. For less critical applications, system 10 simply may employ profiles 36 loaded into memory 20 at the factory. For example, each profile 36 can be determined empirically by measurements taken of the detection signal over a variety of frequency and temperature conditions existing within a standard detection area at the factory. The resulting profiles can be loaded into, for example, ROM or EEPROM. The standard detection area can be configured as a typical detection area in which system 10 will be installed. Each measurement is intended to provide an indication of a threshold value under given temperature and frequency conditions. Accordingly, each measurement is made in the presence of a known movable, heat-emitting target that simulates a desired range of intruder characteristics.

For many applications, in lieu of factory-loaded profiles, it may be desirable to undertake a comprehensive calibration of system 10 at the installation site to generate the profiles. Alternatively, it may be desirable to at least carry out a recalibration in order to adjust factory-loaded profiles for adaptation to the installation site. To carry out a comprehensive calibration of system 10, the technician may initiate a series of detection signal amplitude measurements over a range of known temperatures and frequencies according to a program stored in memory 20 and executed by processor 16. The temperature and frequency ranges can be simulated using adjustable heat-emitting targets that are movable within a detection area. Using the measurements, the program can be further configured to cause processor 16 to build a set of profiles 36 for storage in memory 20. Certain profiles can be adjusted for different detection modes having varying sensitivities. In this manner, the adaptive threshold can be calibrated to uniquely characterize the particular detection area in which system 10 is installed. For on-site calibration, memory 20 should be realized by rewritable memory such as EEPROM. The number of measurements taken will be subject to designer discretion. In critical applications with large data sets, e.g., military applications, the number of measurements and entries may become burdensome. In this case, well known interpolation methods conceivably can be used in building profiles 36 to reduce the size of the task.

A comprehensive calibration upon installation may be desirable for critical applications. In many cases, however, it may be sufficient to adjust a set of profiles 36 loaded into memory 20 at the factory. Again, the factory-loaded profiles 36 can be representative of detection signal amplitude variation under a range of common temperature and frequency conditions. Instead of a comprehensive calibration, however, the factory-loaded profiles 36 may serve as starting points for adjustment or "recalibration." As described above with respect to comprehensive calibration, the technician can initiate a series of predetermined measurements upon installation according to a program stored in memory 20 and executed by processor 16. In this case, the detection signal amplitude measurements could be taken throughout the measurement space. In other words, the measurements can be taken at a number of selected combinations of temperature and frequency. However, the number of measurements taken for purposes of recalibration relative to a factory-loaded profiles 36 can be less than in a comprehensive recalibration. Using this relative lesser number of measurements, the program can be configured to cause processor 16 to carry out error minimization routines to correct the profiles 36 already stored in memory 20. In this manner, profiles 36 can be adapted relatively quickly and easily to the particular detection area in which system 10 is installed. This recalibration approach will be most desirable and practical in critical applications, e.g., military applications, requiring a large number of measurements and entries.

The recalibration technique can be applied not only for adaptation of factory-loaded profiles upon installation of system 10 in a given detection area, as described above, but also to correct for system drift over a period of time following installation. This recalibration to correct for system drift can be initiated, for example, on a periodic basis in line with a maintenance schedule. Also, the recalibration can be initiated by a technician or by a message generated by system 10 following one or more false alarms or known detection failures. Thus, the recalibration can be made relative to factory-loaded profiles, profiles generated upon calibration at installation, or existing profiles previously generated in either manner, i.e., by comprehensive calibration or adaptation of factory-loaded profiles.

Figure 6:
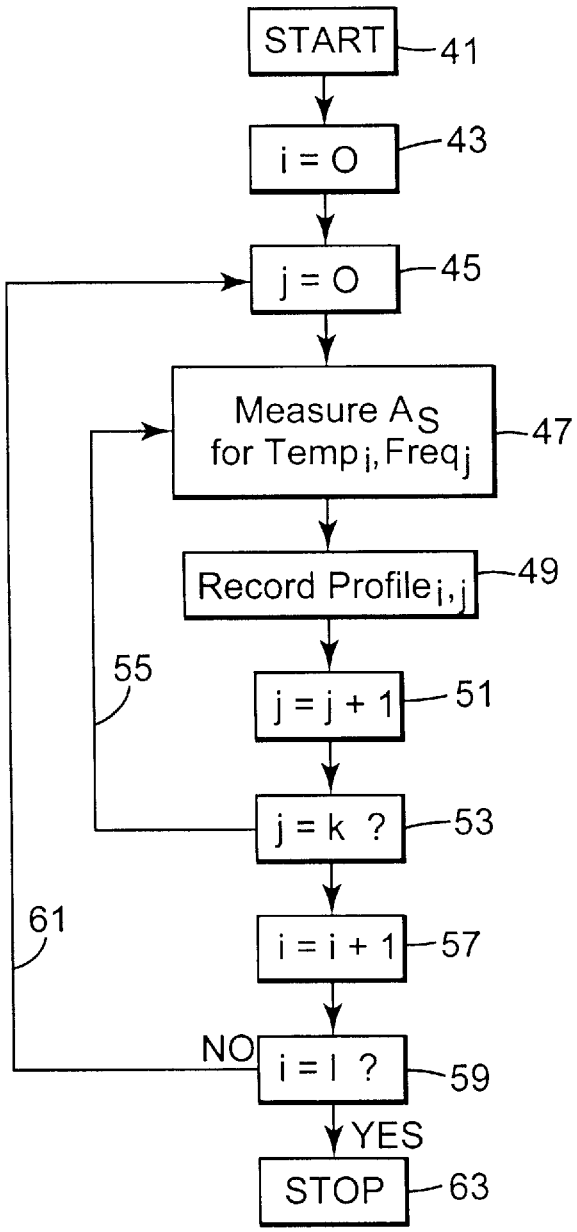
FIG. 6 is a flow diagram illustrating the calibration of a detection system.
Figure 7:
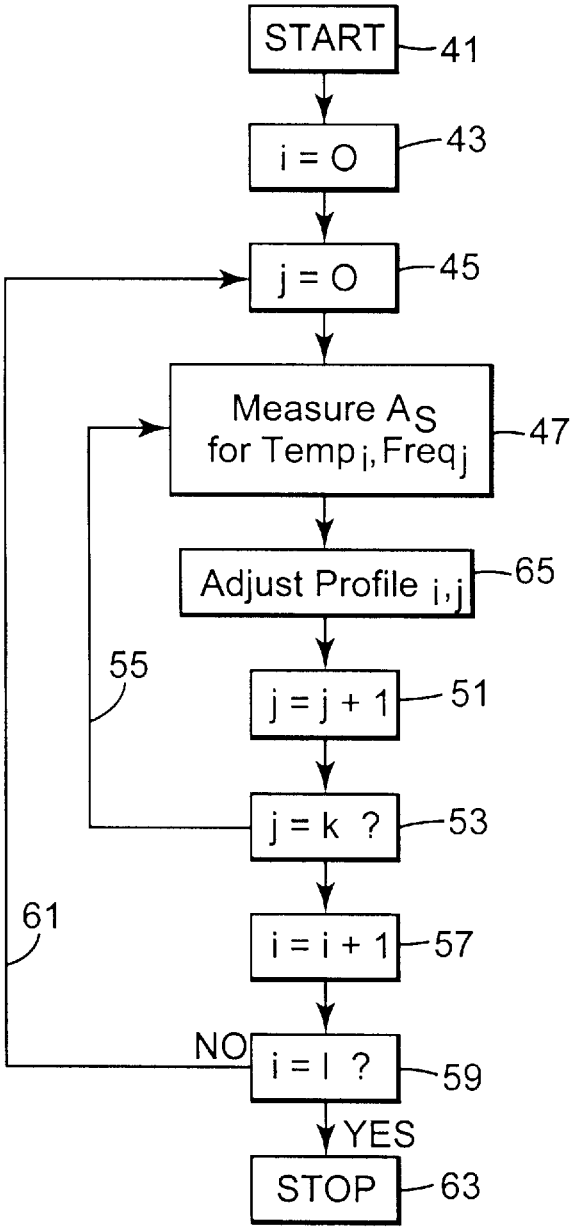
FIG. 7 is a flow diagram illustrating the recalibration of a detection system.

FIG. 6 and 7 are flow diagrams illustrating the calibration and recalibration, respectively, of detection system 10 in accordance with the present invention. With reference to FIG. 6, at the start of the calibration process, indicated by block 41, counters i and j are set to zero, as indicated by blocks 43 and 45. Counters i and j represent the number of temperature and frequency ranges, respectively, for which the detection signal is to be measured. As indicated by block 47, a value $A_s$ of the detection signal is measured for the temperature and frequency conditions identified by counters i and j. The measured value is then recorded in a table address identified by the counters, as indicated by block 49. Next, the frequency counter j is incremented, as indicated by block 51. If the number j of frequency ranges remains less than the number k selected for consideration, the measurement process is repeated, as indicated by block 53 and line 55. In this case, the value of the detection signal is measured at the existing temperature $T_i$, but at a different frequency $F_j$. If the number j of frequency ranges exceeds the number k selected for consideration, the temperature counter i is incremented, as indicated by block 57. If the number i of temperature ranges remains less than the number 1 selected for consideration, the measurement process is repeated and a corresponding value is recorded in a given profile, as indicated by block 59 and line 61. If the number i of temperature ranges exceeds the prescribed number, the calibration process is terminated, as indicated by block 63. The format of the calibration and recalibration described above could, in effect, be inverted. In other words, the loops illustrated in FIGS. 5 and 6 could be inverted to cycle through i temperature ranges for each of i frequency ranges.

FIG. 7 is substantially similar to FIG. 6. In the recalibration process represented by the diagram of FIG. 7, however, a profile is adjusted following measurement, as indicated by block 63. In other words, instead of ascertaining an entire profile for given temperature and frequency combinations, an existing profile for that combination is adjusted for any changes in the threshold value indicated by the measurements. This difference is indicated by block 65 in FIG. 7. Further, the number of iterations represented by counters i and j may be less for recalibration than for calibration. Although the use of well known interpolation techniques may be used to reduce the number of measurements required for calibration, equally well known error minimization techniques may further reduce the number of measurements required for recalibration. Of course, regardless of the number of measurements, care should be taken to identify the particular areas of the measurement space that will be effective in representing the overall response of system 10 to variation in temperature and frequency. Thus, a greater number of measurements may be desirable within an area of the response curve prone to significant variation.

Figure 8:
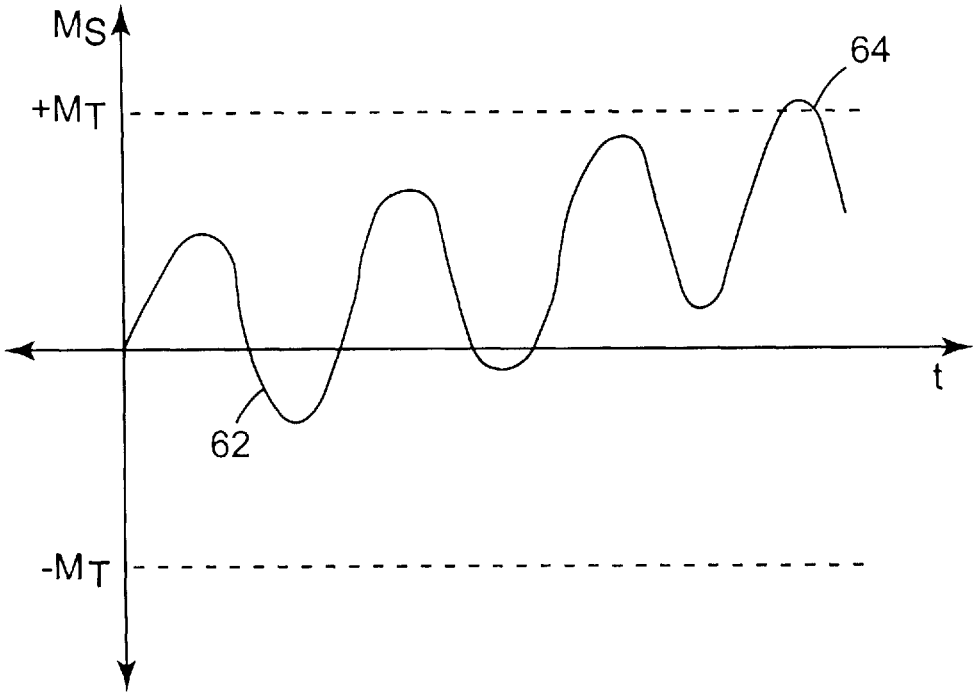
FIG. 8 is a graph illustrating the introduction of a low frequency shift into a detection signal.

FIG. 8 is a graph illustrating the introduction of a low frequency shift into a detection signal due to a slow ac rise or fall. Over time, the detection signal 62 generated by PIR sensor 12 can acquire a slowly changing ac increase or decrease due to factors such as changes in ambient temperature or prolonged presence of an intruder within one or more zones. As shown in FIG. 8, this increase or decrease tends to cause an artificial shift in the magnitude of detection signal 62. Although the output of PIR sensor 12 typically will be ac-coupled to signal processing circuit 14, the resulting rise or fall may resemble a dc offset. The shift can result in a change in the absolute magnitude of detection signal 62 that causes the signal to exceed an applicable comparator threshold, as indicated by reference numeral 64. With such a shift, a detection signal that otherwise would not be indicative of the presence of an intruder may extend outside of a given threshold window. In this case, the detection system may register a false alarm. In systems requiring that the detection signal exceed both upper and lower window thresholds, the shift may cause the absolute magnitude of detection signal 62 to fall above or below one of the thresholds. Consequently, the detection system may not register the presence of an intruder, resulting in a detection failure. In either case, the effectiveness of the detection system is compromised and the security objective suffers.

Figure 9:
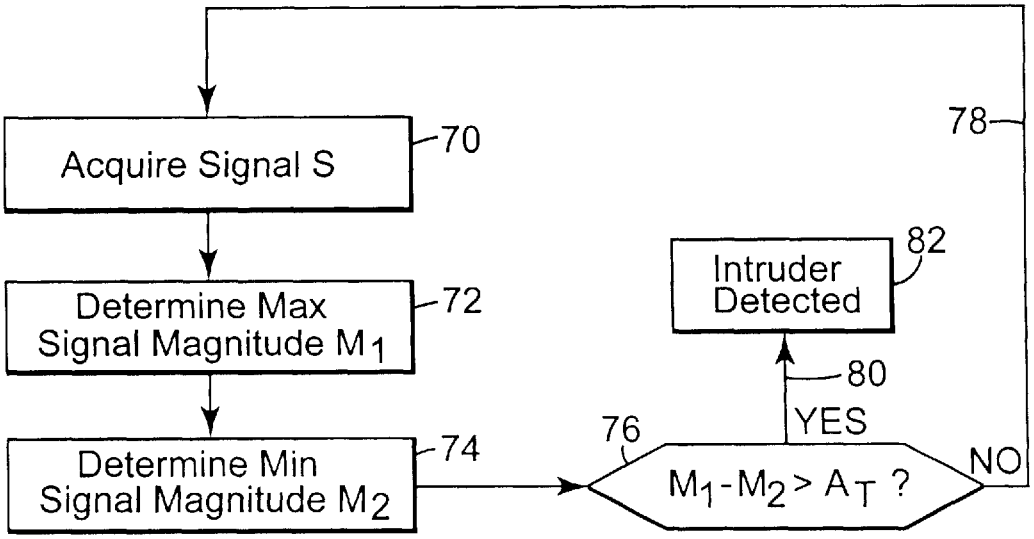
FIG. 9 is a flow diagram illustrating the operation of the detection system of FIG. 1 according to another embodiment of the present invention.

FIG. 9 is a flow diagram illustrating the operation of a detection system and method, in accordance with another embodiment of the present invention, configured to employ relative measurement techniques and adaptive sampling of a detection signal. The use of relative measurement techniques compensates for variations caused by low frequency shifts in the detection signal. Adaptive sampling is used to effectively filter relatively high frequency changes in the detection signal that can undermine the accuracy of relative measurement techniques. For purposes of illustration, operation will be described with reference to the structure and functionality of system 10. Although a system 10 constructed as shown in FIG. 1 may be used, temperature sensor 18 is not essential for practice of this second embodiment. Further, an adaptive threshold as described with respect to the first embodiment of the present invention and FIGS. 1–5 may be used for added advantage, but is not essential.

In accordance with this embodiment, processor 16 is programmed to sample a detection signal in a manner that enables the reduction of false alarms due to low frequency shifts in signal magnitude. Specifically, instead of determining an absolute magnitude of the detection signal, processor 16 is programmed to determine a peak-to-peak amplitude of the detection signal. The peak-to-peak amplitude provides an indication of the amplitude of the detection signal exclusive of any low frequency magnitude shift that may have been introduced. Processor 16 then compares the peak-to-peak amplitude of the detection signal to a threshold amplitude. In the event the peak-to-peak amplitude is greater than the threshold amplitude, processor 16 generates a signal indicative of the presence of an intruder within the detection area. The event triggering intruder detection is described as the acquisition of a detection signal having an amplitude greater than the threshold amplitude. However, it is not important whether the amplitude is greater than or equal to the threshold amplitude for triggering so long as the amplitude is in some way compared to an appropriately selected threshold amplitude.

As shown in FIG. 9, a detection signal S is first acquired, as indicated by block 70. By sampling signal S over a given time period, processor 16 determines both a maximum signal magnitude $M_1$ and a minimum signal magnitude $M_2$ for that period, as indicated by blocks 72 and 74, respectively. In operation, processor 16 may determine maximum and minimum detection signal magnitudes $M_1$, $M_2$ by detecting changes in the slope of the detection signal, and recording the magnitudes of the signal at the time of each slope change. The technique for determining maximum and minimum detection signal magnitude $M_1$, $M_2$, along with detection signal frequency, will be described in greater detail later in this description.

After determining maximum and minimum detection signal magnitudes $M_1$, $M_2$, processor 16 subtracts one from the other to determine a peak-to-peak amplitude $M_1$–$M_2$. This peak-to-peak amplitude eliminates the low frequency shift that could be incorporated if measurement were made relative to a circuit ground potential. Processor 16 then compares the peak-to-peak amplitude to a threshold amplitude $A_T$, as indicated by block 76. In accordance with this second embodiment, threshold amplitude $A_T$ may be selected to provide an adaptive threshold as described above with respect to the first embodiment and FIGS. 1–5. Alternatively, a static threshold may be used. If the peak-to-peak amplitude does not exceed the threshold amplitude $A_T$, processor 16 proceeds to the next sample and repeats the process, as indicated by line 78. If the peak-to-peak amplitude does exceed the threshold amplitude $A_T$, however, processor 16 generates a signal indicative of the presence of an intruder, as indicated by line 80 and block 82. As will be described, processor 16 may be programmed to analyze additional portions of the signal relative to the threshold as a verification step prior to indicating an alarm condition.

Figure 10:
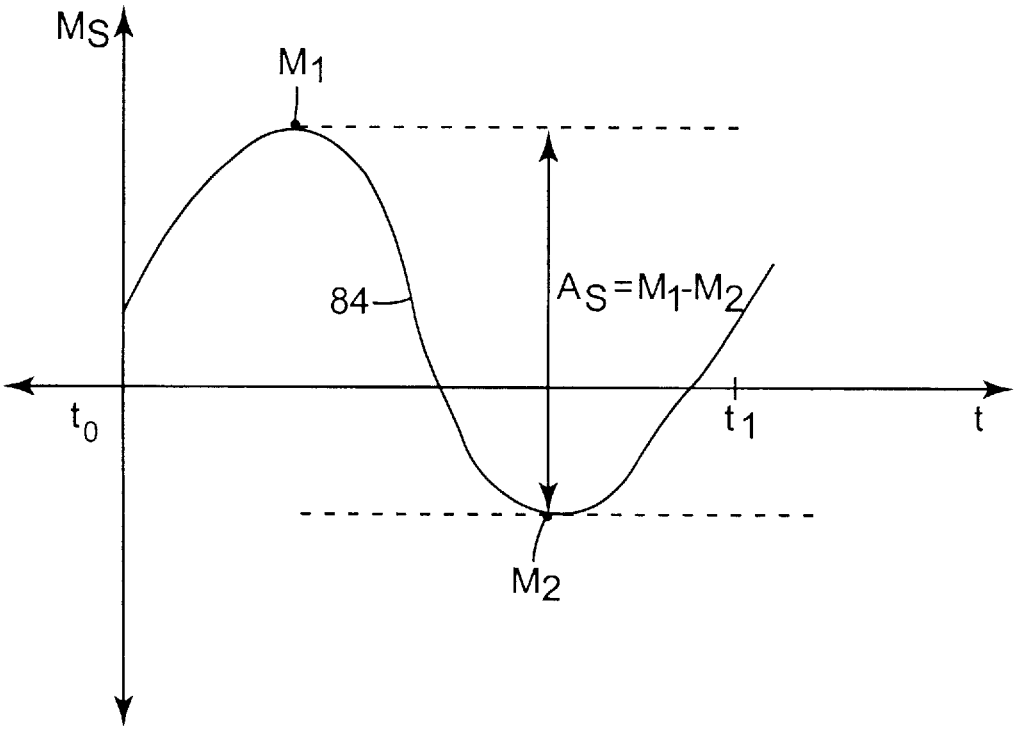
FIG. 10 is a graph illustrating the measurement of a detection signal according to the embodiment of FIG. 9.
Figure 11:
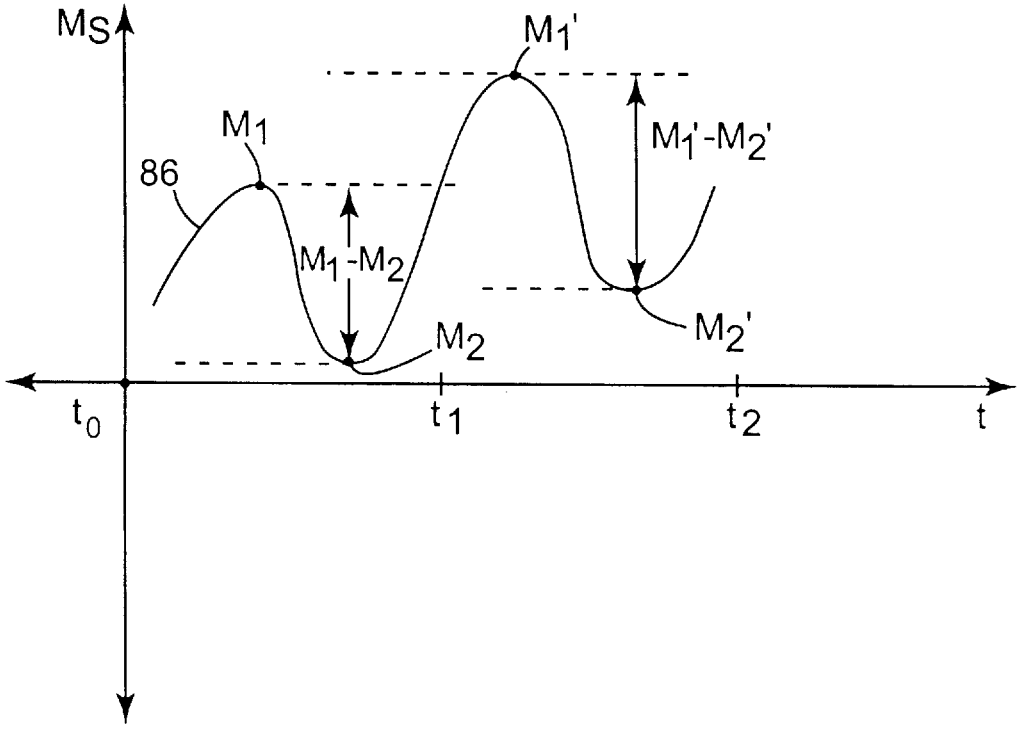
FIG. 11 is another graph illustrating the measurement of a detection signal according to the embodiment of FIG. 9.

FIGS. 10 and 11 are graphs illustrating the measurement of a detection signal to compensate for low frequency shift, in accordance with the present invention. With reference to FIG. 10, a maximum magnitude $M_1$ and minimum magnitude $M_2$ are determined for time $t_0$–$t_1$ by monitoring changes in the slope of detection signal 84. The difference $A_s$ provides a measurement of peak-to-peak amplitude for comparison to threshold amplitude $A_T$. The introduction of increased low frequency shift in the detection signal over time does not affect the measurement. Specifically, as shown in FIG. 11, over successive time periods $t_0$–$t_1$, $t_1$–$t_2$, maximum and minimum magnitude $M_1$, $M_2$ of detection signal 86 may increase to $M_1'$ and $M_2'$, respectively. Nevertheless, the peak-to-peak amplitude $M_1'$–$M_2'$ continues to provide a measure of the detection signal amplitude, thereby eliminating the effects of low frequency shift. Consequently, the comparison of detection signal amplitude, as measured, to a threshold amplitude does not suffer from the unpredictability introduced by shift-induced variations. Again, the result is a reduction in false alarms and detection failures.

Figure 12:
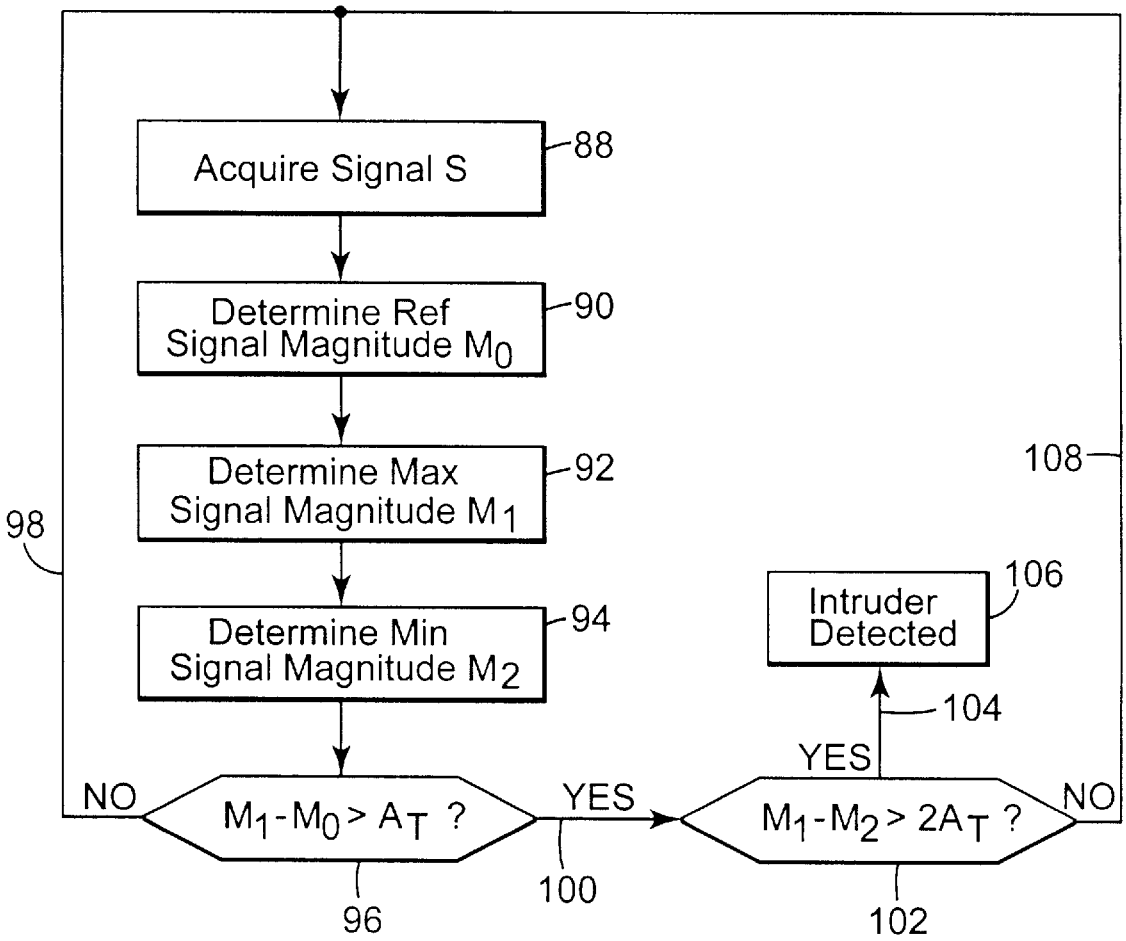
FIG. 12 is a flow diagram illustrating the operation of the detection system of FIG. 1 according to another embodiment of the present invention.

FIG. 12 is a flow diagram illustrating the operation of a detection system and method, in accordance with another embodiment of the present invention, configured to employ relative measurement and adaptive sampling techniques to compensate for variations caused by low frequency shift in the detection signal. Again, for purposes of illustration, operation will be described with reference to the structure and functionality of system 10 of FIG. 1, even though use of a temperature signal and adaptive threshold are not essential. According to this embodiment, in addition to determining peak-to-peak amplitude of a detection signal, processor 16 is programmed to determine a peak-to-reference amplitude. A peak-to-reference amplitude is intended to refer to an amplitude measured according to the difference between an initially sampled value and a maximum value of the detection signal prior to a first slope change. If the initially sampled value is selected as a value immediately before a slope change, the peak-to-reference amplitude is effectively a peak-to-peak amplitude.

The analysis of a first peak-to-peak or peak-to-reference amplitude followed by a second peak-to-peak amplitude is desirable as an added precaution in avoiding false alarms. The consecutive peak-to-reference and peak-to-peak amplitudes form "slopes," respectively, and together form a "pulse." It is preferable, however, that two or more pulses be analyzed relative to the threshold to provide a verification step in which successive measurements are required prior to triggering. Thus, in this mode, processor 16 generates an alarm signal only if an excursion of the detection signal amplitude above the threshold amplitude persists for a number of pulses.

Processor 16 is programmed, in this embodiment, to compare the peak-to-reference amplitude to a first threshold amplitude, and compare the peak-to-peak amplitude of the detection signal to a second threshold amplitude. The peak-to-reference comparison indicates whether the sampled signal indicates the onset of an event potentially indicative of the presence of an intruder. The peak-to-peak comparison attempts to confirm whether an intruder is present. The second threshold amplitude may be, for example, set to approximately two times the first threshold amplitude. In the event the peak-to-reference amplitude is greater than the first threshold amplitude and the peak-to-peak amplitude is greater than the second threshold amplitude, processor 16 generates a signal indicating the presence of an intruder within the detection area.

Figures 13, 14:
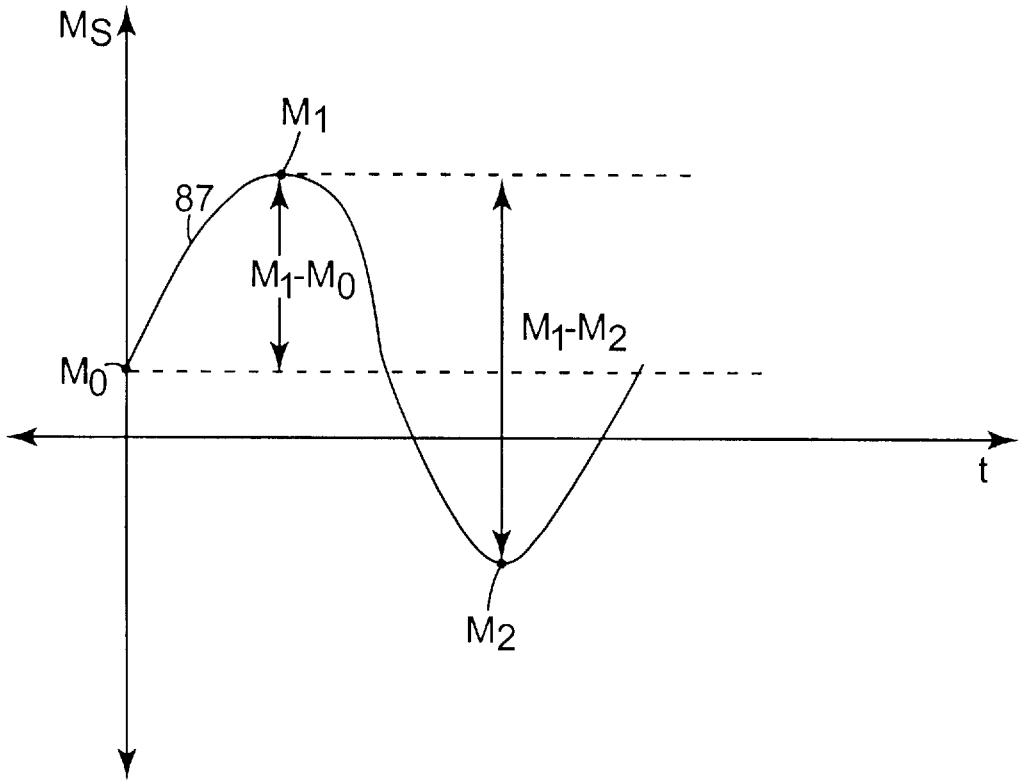
FIG. 13 is a graph illustrating the measurement of a detection signal according to the embodiment of FIG. 12.
FIG. 14 is a diagram illustrating the storage of measured amplitude and time parameters in a buffer.

FIG. 13 is a graph illustrating the measurement of a detection signal 87 in accordance with this third embodiment. With further reference to FIG. 12, according to this third embodiment, processor 16 acquires samples of the detection signal S over selected periods of time, as indicated by block 88. In addition to detecting maximum and minimum magnitudes $M_1$, $M_2$ of the detection signal, as indicated by blocks 92 and 94, respectively, processor 16 designates one of the first acquired samples as a reference amplitude $M_0$, as indicated by block 90. Processor 16 then performs the first comparison to determine whether the signal S indicates a potential intruder event and should be analyzed further. Specifically, as indicated by block 96, processor 16 determines whether the peak-to-reference amplitude $A_R=M_1-M_0$ is greater than the first threshold amplitude $A_T$. If not, processor 16 proceeds to the next sample, as indicated by line 98. If so, as indicated by line 100 and block 102, processor 16 performs the second comparison, whereby the peak-to-peak amplitude $A_S$ is compared to a second threshold, such as $2A_T$. In this example, if the peak-to-peak amplitude $A_s$ is greater than $2A_T$, processor 16 generates a signal indicative of the presence of an intruder within the detection area, as indicated by line 104 and block 106. If not, processor 16 proceeds to the next sample, as indicated by line 108.

For purposes of example, FIG. 12 illustrates a series of successive steps that are performed following acquisition of a complete waveform for signal S over an entire time interval. It should be understood, however, that the comparison of the peak-to-reference amplitude $A_R$ to the first threshold amplitude may serve as a prerequisite to further analysis of the sampled signal. In other words, if the first comparison does not indicate a potential intruder event, processor 16 may be programmed to simply proceed to the next sample. According to this approach, if the first comparison indicates a potential intruder event, processor 16 may be programmed to determine the minimum amplitude $M_2$. In summary, processor 16 may carry out the operations shown in FIG. 12 either post-acquisition or on-the-fly, depending on its capabilities and processing load, and user choice given the nature of the detection application.

Processor 16 preferably is programmed to increase its sampling rate following the indication of a potential intruder event and, in effect, employ an adaptive sampling rate. For example, processor 16 may be programmed to sample signal S every sixty milliseconds as a default. If the detection signal S indicates potential intruder activity by exhibiting a change over consecutive samples, processor 16 may be programmed to increase the sampling rate. Potential intruder activity may be indicated by a change in the slope of the detection signal. Upon detection of potential intruder activity, processor 16 may increase the sampling rate to sample signal S every fifteen to twenty milliseconds. In this manner, processor 16 is programmed for increased sampling rate only at pertinent times, i.e., in the presence of a potential intruder, thereby conserving battery power for extended PIR detector usage. The adaptive sampling rate used by the present invention will be discussed in greater detail with respect to the flow diagrams of FIGS. 18*a*–18*b*, 19*a*–19*b*, 20, 21*a*–21*b*, 22*a*–22*b*, and 23*a*–23*e*.

FIG. 14 is a diagram illustrating the storage of measured amplitude and time parameters in a buffer for efficient measurement and comparison of the amplitude and frequency of a detection signal in accordance with the present invention. Processor 16 defines in memory 20 a buffer 110, as shown in FIG. 14. In buffer 110, processor 16 defines a number of storage locations $B_0$–$B_7$ addressable via a buffer pointer. The use of buffer 110 will be described with general reference to the operation of the embodiment of FIG. 12. As processor 16 acquires an initial detection signal amplitude $M_0$, it stores that amplitude at buffer location $B_0$. As processor 16 detects a change in the slope of signal S, e.g., by comparing magnitude values for successive samples, it measures a maximum magnitude $M_1$.

Processor 16 then stores in buffer location $B_1$ a value representative of the time $t_0$ elapsed between $M_0$ and $M_1$ by reference to the number of intervening samples and the sampling rate. Processor 16 stores at buffer location $B_2$ a time $t_{01}$ during which signal S remains at the maximum magnitude $M_1$, i.e., a flat time. In buffer location $B_3$, processor 16 stores maximum magnitude $M_1$. Next, when processor 16 detects another change in the slope of signal S, it measures minimum magnitude $M_2$. Processor 16 stores at buffer location $B_4$ the time $t_1$ elapsed between the slope change from $M_1$ to the slope change to $M_2$. In buffer location $B_5$, processor 16 stores the flat time $t_{12}$ during which signal S remains at minimum magnitude $M_2$. Finally, in buffer location $B_6$, processor 16 stores the minimum magnitude $M_2$. It is noted that the format of buffer 110 will be subject to designer discretion, and that time and magnitude values could be stored in separate buffers.

With the contents of buffer 110 for a particular series of pulses, processor 16 can calculate a number of parameters in a straightforward manner without undue processing overhead. To determine the peak-to-reference amplitude $A_R$, processor 16 simply subtracts the contents of buffer location $B_0$ from those of buffer location $B_3$. Similarly, to determine the peak-to-peak amplitude $A_s$, processor 16 subtracts the contents of buffer location $B_6$ from those of buffer location $B_3$. To calculate the frequency f of signal S, processor 16 can invert the contents $t_1$ of buffer location $B_4$ or use the $t_1$ value itself as an indication of frequency. The frequency parameter is important for the selection of a threshold amplitude from memory 20 in the event an adaptive threshold is used. The value $t_0$ in buffer location $B_1$ may be useful as an indication of whether the peak-to-reference amplitude was acquired over a period long enough to provide meaningful information, instead of a transient-induced anomaly. In the latter case, this value can be assessed by processor 16 as it is loaded into buffer 110. Based on the assessment, processor 16 can determine whether the present sample should be discarded or subjected to further analysis.

Figure 15:
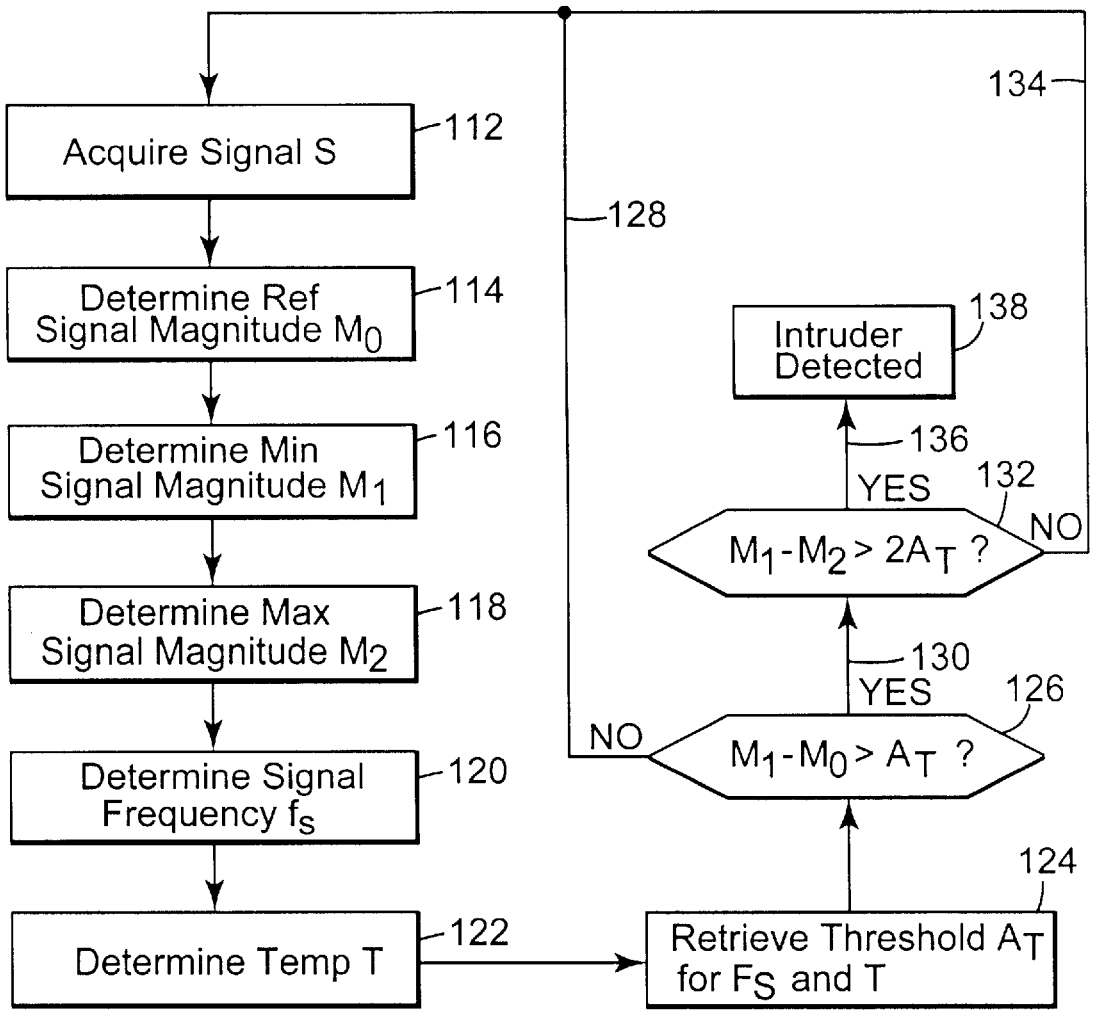
FIG. 15 is a flow diagram illustrating the operation of the detection system of FIG. 1 according to another embodiment of the present invention.

FIG. 15 is a flow diagram illustrating the operation of a detection system and method, in accordance with another embodiment of the present invention, configured to compensate for temperature-, frequency-, and shift-induced variations in detection signal amplitude. The operation of a system and method in accordance with this embodiment will be described with reference to the structure and functionality of system 10 in FIG. 1. In this embodiment, system 10 essentially combines the features of the various embodiments described above. For example, according to this embodiment, system 10 makes use of an adaptive threshold to compensate for temperature- and frequency-induced variations in detection signal amplitude. At the same time, system 10 undertakes relative measurement and adaptive sampling of the detection signal by measuring a peak-to-peak amplitude for comparison to the adaptive threshold, thereby compensating for variation due to magnitude shift. Through a combination of adaptive thresholds, relative measurement, and adaptive sampling, system 10 is capable of further enhancing its effectiveness in avoiding false alarms and detection failures.

As indicated by block 112 in FIG. 15, in this fourth embodiment, processor 16 acquires detection signal S. Along with determination of maximum, minimum, and reference magnitude samples $M_0$, $M_1$, $M_2$, as indicated by blocks 114, 116, 118, respectively, processor 16 determines the frequency $f_s$ of the detection signal S, as indicated by block 120, and obtains temperature T from temperature sensor 18 or memory 20, as indicated by block 122. Based on the frequency $f_s$ and temperature T, processor 16 selects one of the threshold amplitudes in memory 20, as indicated by block 124. In this manner, processor 16 provides an adaptive threshold for comparison to a peak-to-reference amplitude $A_R=M_1-M_0$, as indicated by block 126. If peak-to-reference amplitude $A_R$ is not greater than threshold amplitude $A_T$, processor 16 proceeds to the next sample, as indicate by line 128. If peak-to-reference amplitude $A_R$ exceeds threshold amplitude $A_T$, however, processor 16 determines, as indicated by block 132, whether peak-to-peak amplitude $M_1-M_2$ is greater than an amplitude greater than $A_T$ such as, for example, $2A_T$. If not, processor 16 proceeds to the next sample, as indicated by line 134. If so, processor 16 generates a signal indicative of the presence of an intruder, as indicated by block 138.

Figure 16:
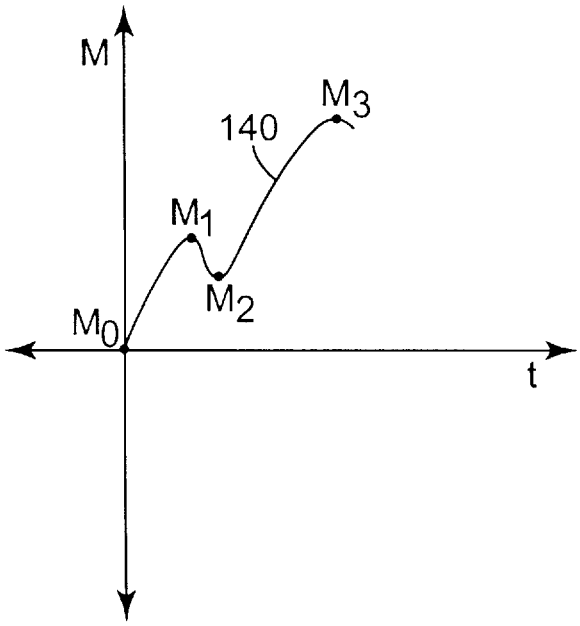
FIGS. 16 and 17 are graphs of a detection signal illustrating different scenarios that may be encountered using relative measurement techniques according to the present invention.
Figure 17:
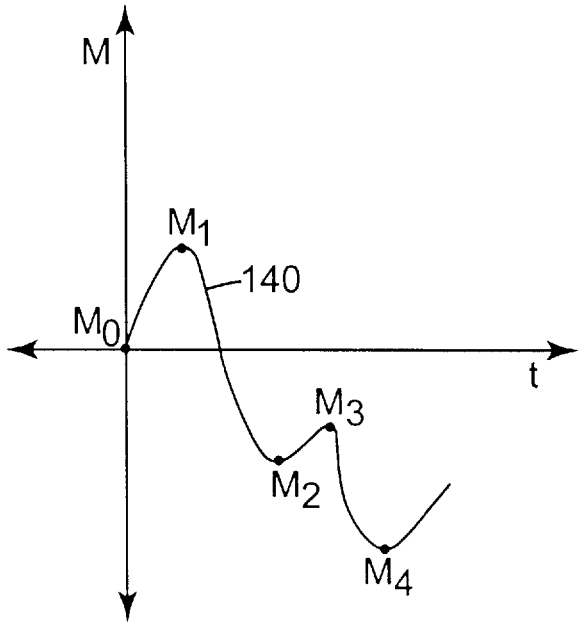

FIGS. 16 and 17 are graphs of a detection signal 140 illustrating different scenarios that may be encountered with the relative measurement techniques of the present invention. As described above, the relative measurement techniques of the present invention identify signal maxima and minima in part by tracking slope changes. Consequently, the slightest "glitch" in a signal can result in the capture of erroneous maxima or minima that could cause the relative measurement technique to misrepresent signals indicative of intruder presence. FIG. 16 illustrates the occurrence of such a "glitch" in the upward slope of signal 140. A glitch refers to any slope change that may occur due to factors such as sudden movement of an intruder or other transient conditions within the detection area including electrical noise. Such glitches may result, for example, from the crossing of an intruder's arms, legs, or head across zones, as well as a bobbing or lurching gait to the intruder's walk. The actual magnitude peak $M_3$ of signal 140 could indicate intruder presence when compared to the initially sampled value $M_0$. Based on slope changes, however, the relative measurement technique would load the glitch-induced value $M_1$ into buffer 110, shown in FIG. 14. FIG. 17 similarly illustrates the introduction of a glitch that could cause the capture of magnitude $M_2$ instead of $M_4$ as the value representative of the minimum peak of signal 140. A variety of other possible scenarios also can compromise the effectiveness of the relative measurement technique.

In accordance with the present invention, however, relative measurement techniques are provided that employ an adaptive sampling algorithm sufficient to avoid reliance on glitch-induced slope changes. As illustrated by the flow diagram of FIGS. 18*a*–18*b*, 19*a*–19*b*, 20, 21*a*–21*b*, 22*a*–22*b*, and 23*a*–23*e*, this algorithm enables the detection of glitch-induced magnitudes and the substitution of appropriate peak values. In particular, the algorithm operates to shift values loaded into buffer 110 into appropriate positions prior to final analysis of the buffer contents for purposes of threshold comparison. In this manner, noise is excluded from the digital representation of the detection signal to enable more effective relative measurement of the detection signal.

Figure 18A:
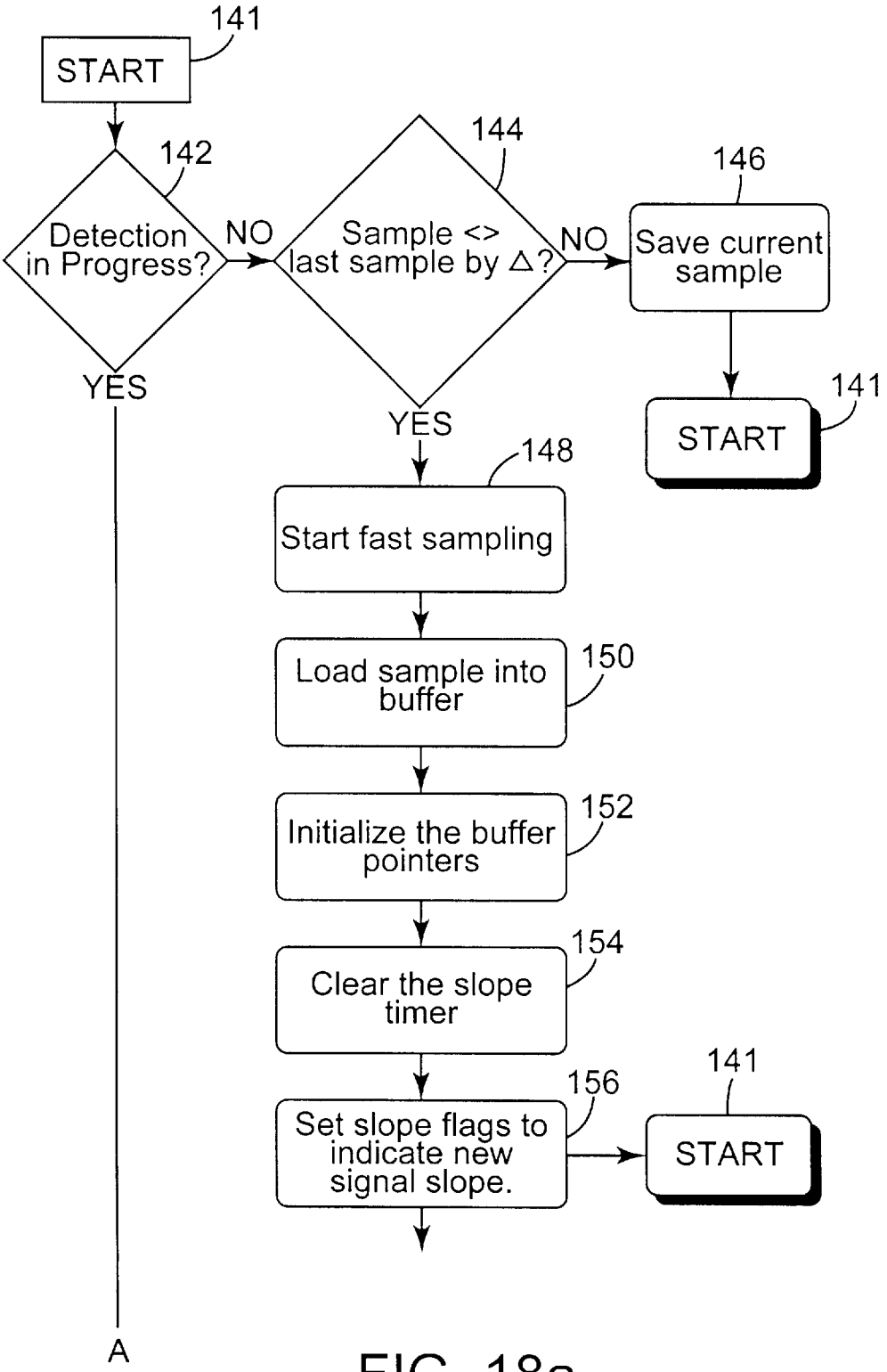
FIGS. 18*a*–18*b*, 19*a*–19*b*, 20, 21*a*–21*b*, 22*a*–22*b*, and 23*a*–23*e* together provide a flow diagram illustrating the operation of relative measurement and adaptive sampling techniques.
Figure 18B:
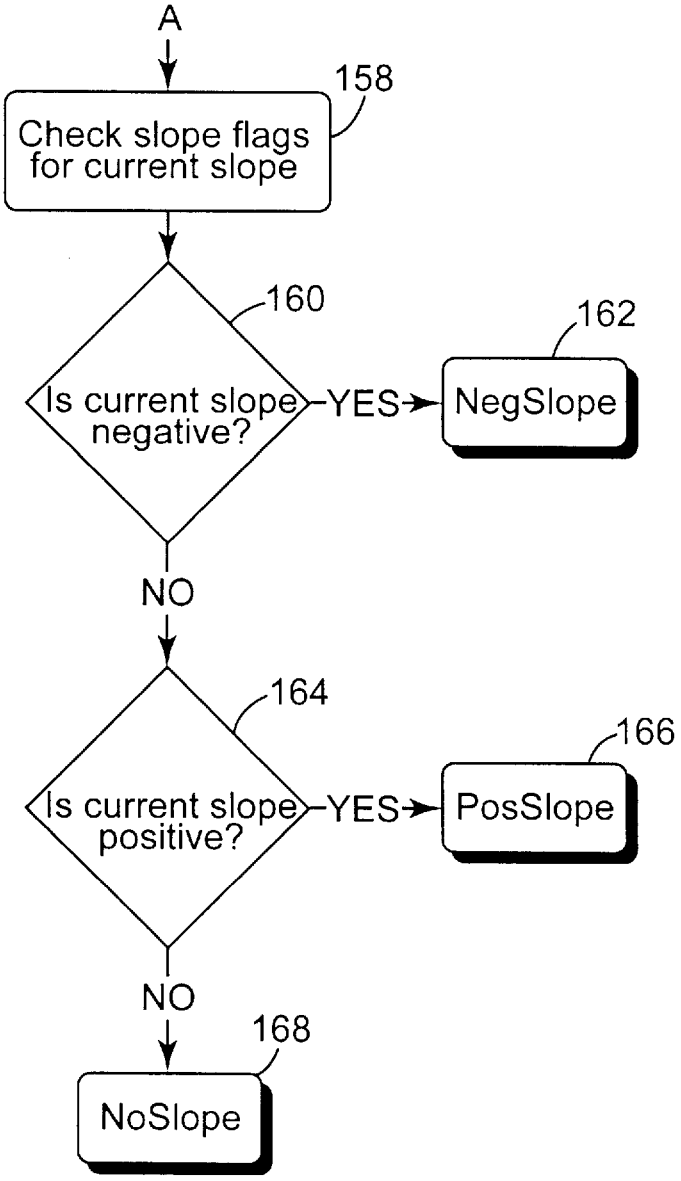

With reference to blocks 141 and 142 of FIG. 18*a*, from the start of process flow, if a detection is not in progress, i.e., processor 16 is sampling the output of signal processing circuit 14 at a slower rate because it has not yet detected any samples indicative of movement, processor 16 determines whether a most recently acquired sample of the detection signal varies from the previously acquired sample by more than a predetermined amount, as indicated by block 144. If not, processor 16 saves the most recently acquired, or current, sample in RAM, as indicated by block 146, and returns to the start, as indicated by block 141. If the present sample exceeds the previous sample by the predetermined amount, however, processor 16 notes a potential intruder event and increases the rate at which the detection signal is sampled, as indicated by block 148. With reference to blocks 150, 152, 154, and 156, respectively, processor 16 loads the previous sample into buffer 110 as sample $M_0$, initializes the buffer pointers, clears a slope timer that tracks the time between detected changes in the slope of the detection signal, and sets a slope flag indicating the onset and polarity of a slope change. Processor 16 then returns to the start, as indicated by block 141. With reference to FIG. 18*b*, if a detection is in progress as a result of a detected signal change, processor 16 checks the slope flag to determine the current slope, as indicated by block 158. If the slope is negative, processor 16 enters a negative slope routine, as indicated by blocks 160, 162. If the slope is positive, processor enters a positive slope routine, as indicated by blocks 164, 166. If the slope is zero, processor 16 enters a no slope routine, as indicated by block 168.

Figure 19A:
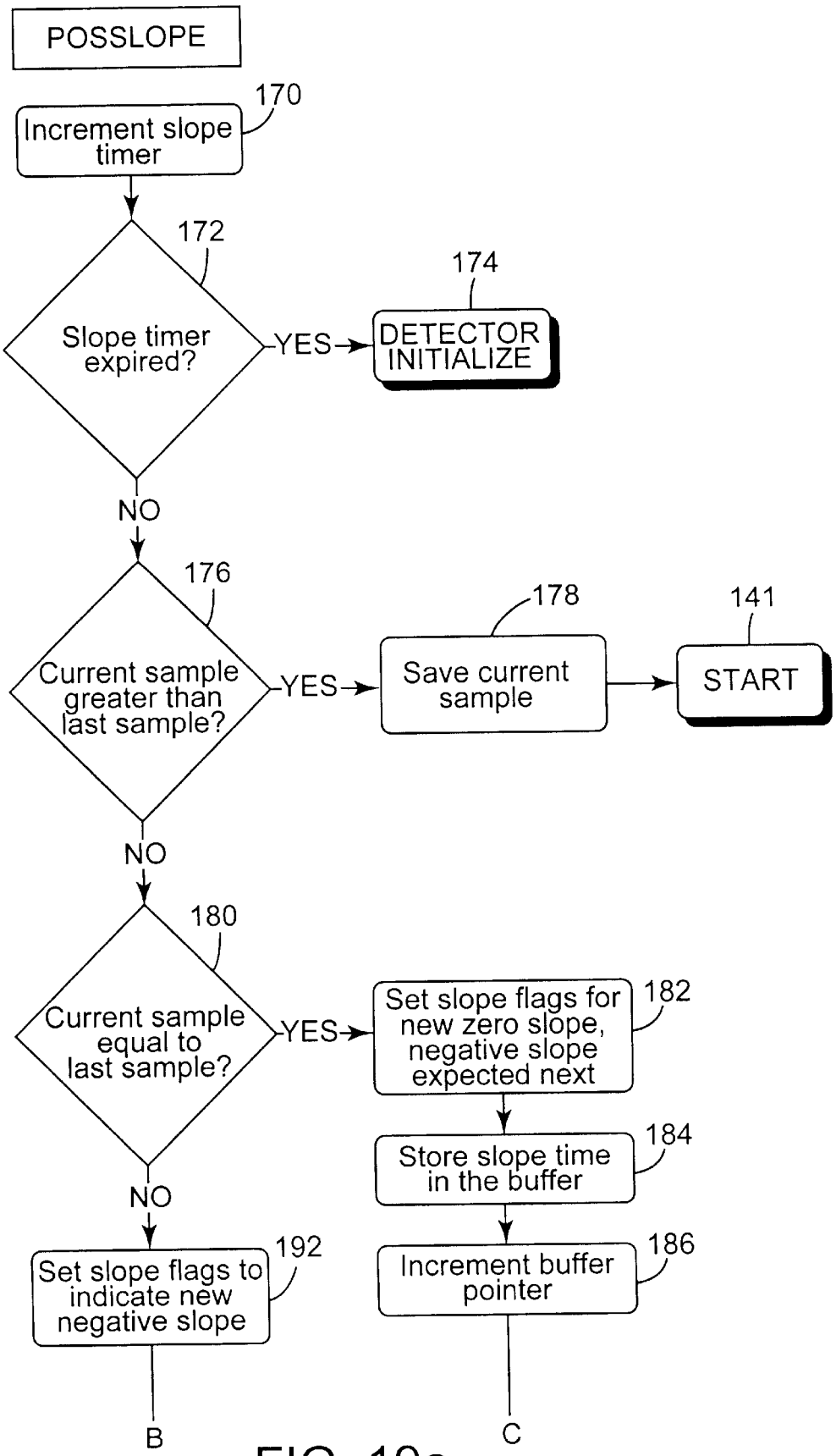
Figure 19B:
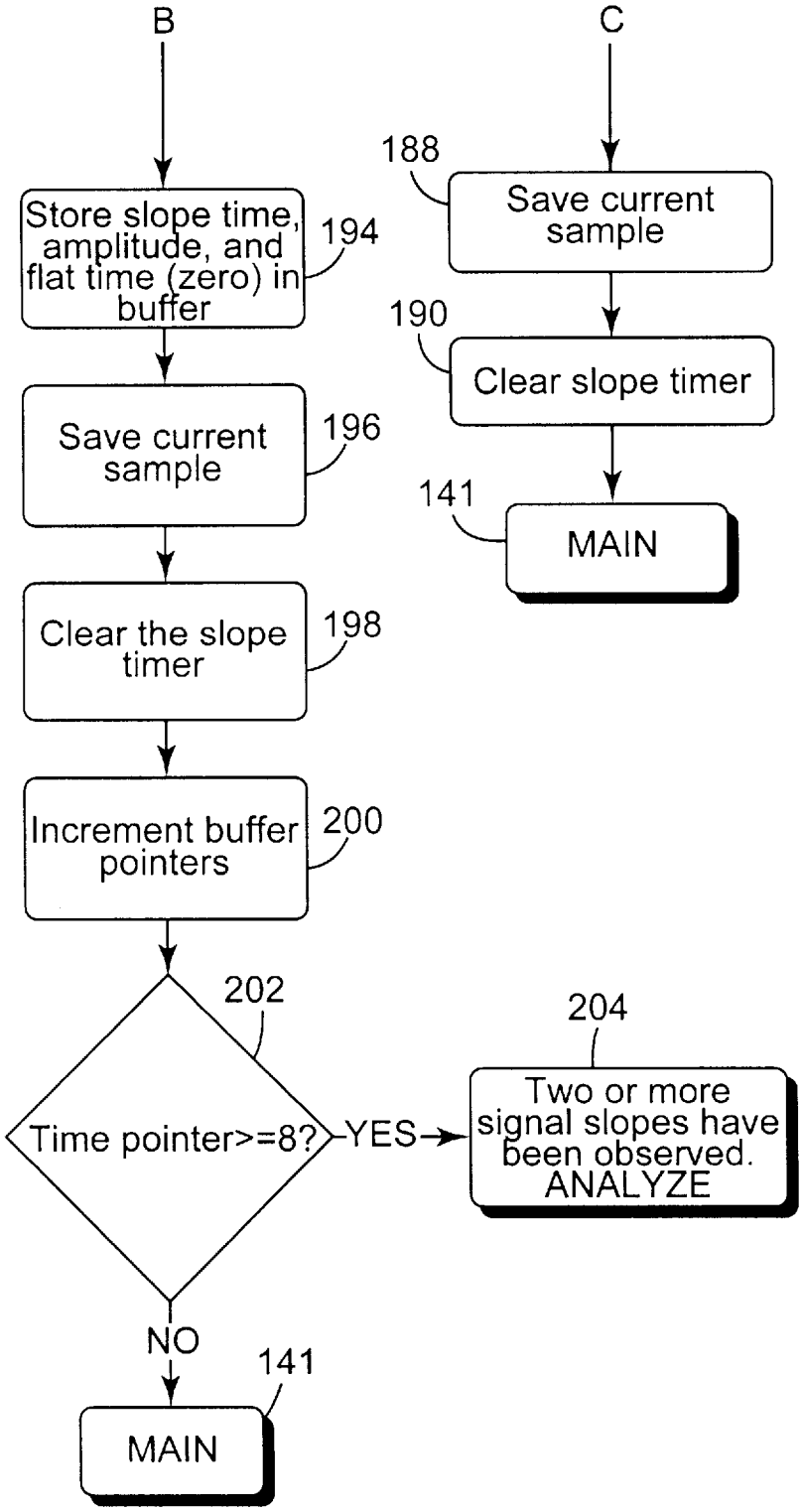

With reference to FIG. 19*a*, in the positive slope routine, processor 16 increments the slope timer for each sample, as indicated by block 170, and determines whether the slope timer has exceeded an applicable limit, as indicated by block 172. If so, processor 16 initializes the buffer pointers and applicable flags and timers via an initialization routine for a restart of the detection process, as indicated by block 174. If not, as indicated by block 176, processor 16 next determines whether the current sample is greater than the previous sample. If so, processor 16 saves the current sample in RAM and returns to the start of detection process flow, as indicated by blocks 178 and 141. With reference to blocks 180 and 182, if the current sample is equal to the previous sample, the signal is in a flat condition, and processor 16 resets the slope flag to indicate no slope. At this point, processor 16 stores the time elapsed from the previous sample to the current sample in buffer 110 as the slope time, as indicated by block 184, and increments the buffer pointer, as indicated by block 186. With reference to blocks 188, 190, and 141 in FIG. 19*b*, processor 16 then saves the current sample RAM, clears the slope timer in anticipation of an upcoming slope change for calculation of the flat slope time, and returns to the start. If the positive slope routine were entered immediately following start of the detection process, at this point, the buffer contents would include the previous sample at buffer location $B_0$ and the slope time at buffer location $B_1$. The flat time would be determined and included in buffer location $B_2$ following a slope change identified in the no slope routine, which will be described with reference to FIGS. 22*a*–22*b*.

With further reference to FIG. 19*a*, if the current sample is less than the previous sample, processor 16 sets the slope flag to indicate a negative slope, as indicated by block 192. Processor 16 then stores the slope time between the current sample and the sample at the last slope change, the amplitude of the current sample, and flat time, in buffer 110, as indicated by block 194 of FIG. 19*b*. As indicated by block 196, processor 16 saves the current sample to a location in RAM for reference. As indicated by blocks 198, 200, processor 16 also clears the slope timer and increments the buffer pointers. If a time pointer is greater than or equal to eight, as indicated by block 202, at least two signal slopes have been obtained. In this case, processor 16 enters an analysis routine, as indicated by block 204. A time pointer can be separately maintained to track the number of slope times and flat times. If the buffer pointer indicates that four times have been acquired, then two slopes have been acquired. Thus, if the time pointer is less than the applicable value indicating the acquisition of two slopes, processor 16 proceeds to the start of process flow to acquire another slope, as indicated by block 141.

Figure 20:
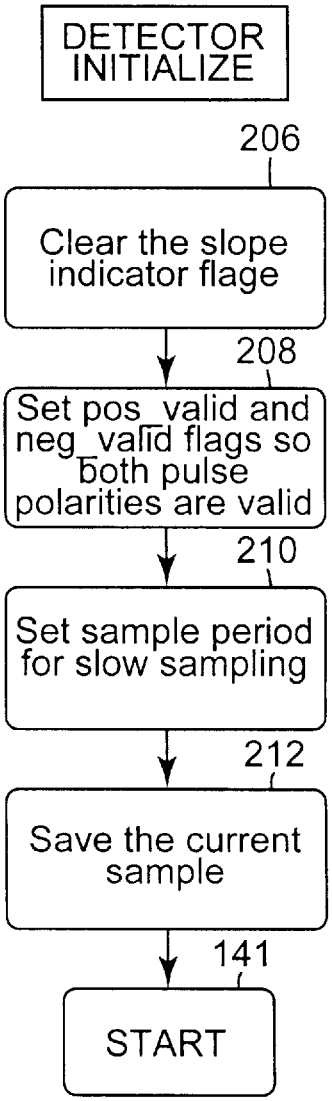

FIG. 20 illustrates the detector initialization routine for restart of the detection process upon the elapse of the slope timer, completion of signal analysis, or any other condition demanding restart. With reference to FIG. 20, processor 16 initializes the detection process by clearing all slope flags, as indicated by block 206. With reference to block 208, processor 16 also sets polarity flags such that negative or positive slopes are valid at the outset of the detection process. As indicated by blocks 210, 212, and 141, processor 16 resets the sampling rate to a slow mode, stores the current sample as the first sample, and proceeds to the next sampling cycle. The first sample becomes the basis for comparison in determining whether the sampling rate should be increased.

Figure 21A:
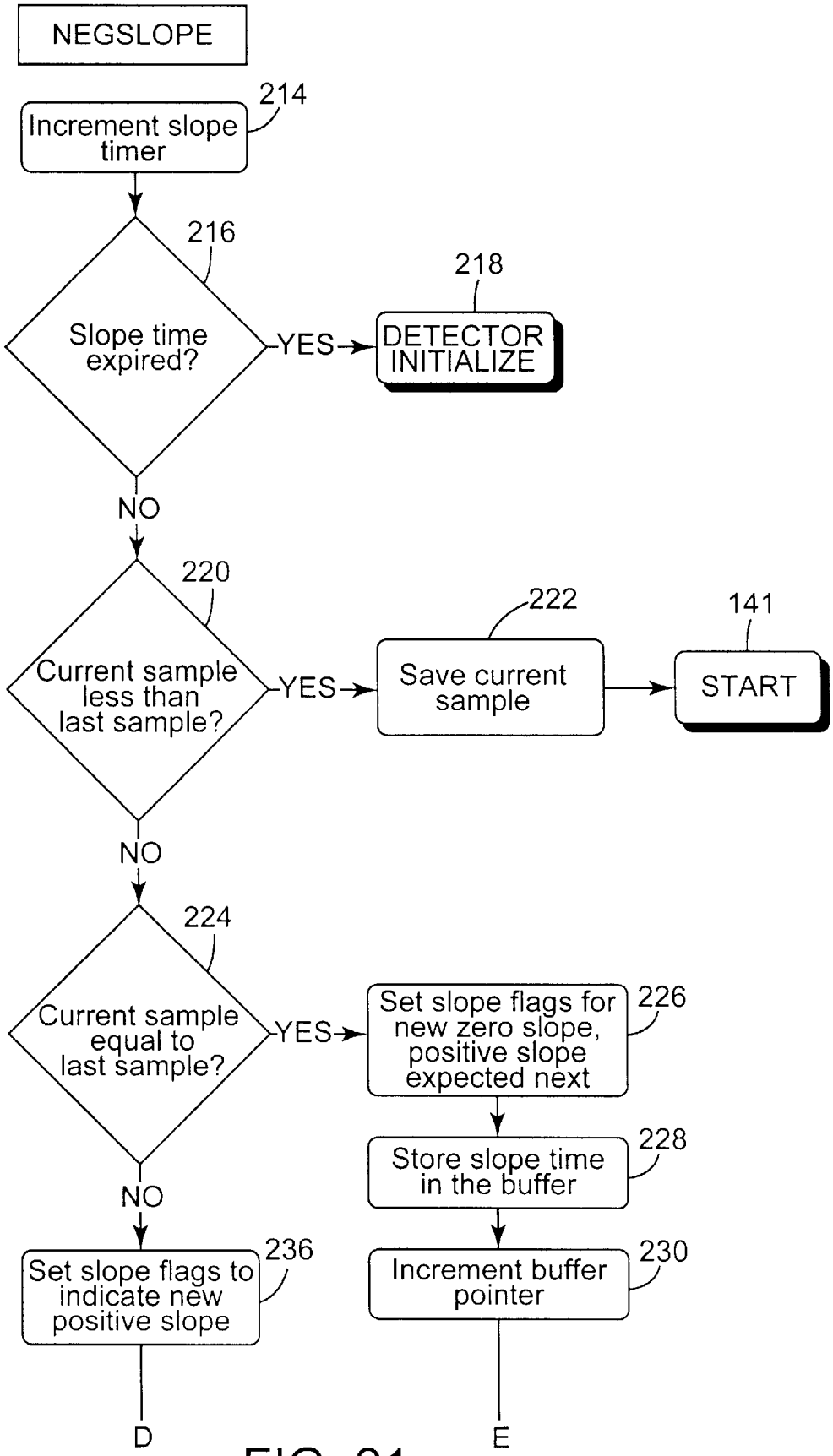
Figure 21B:
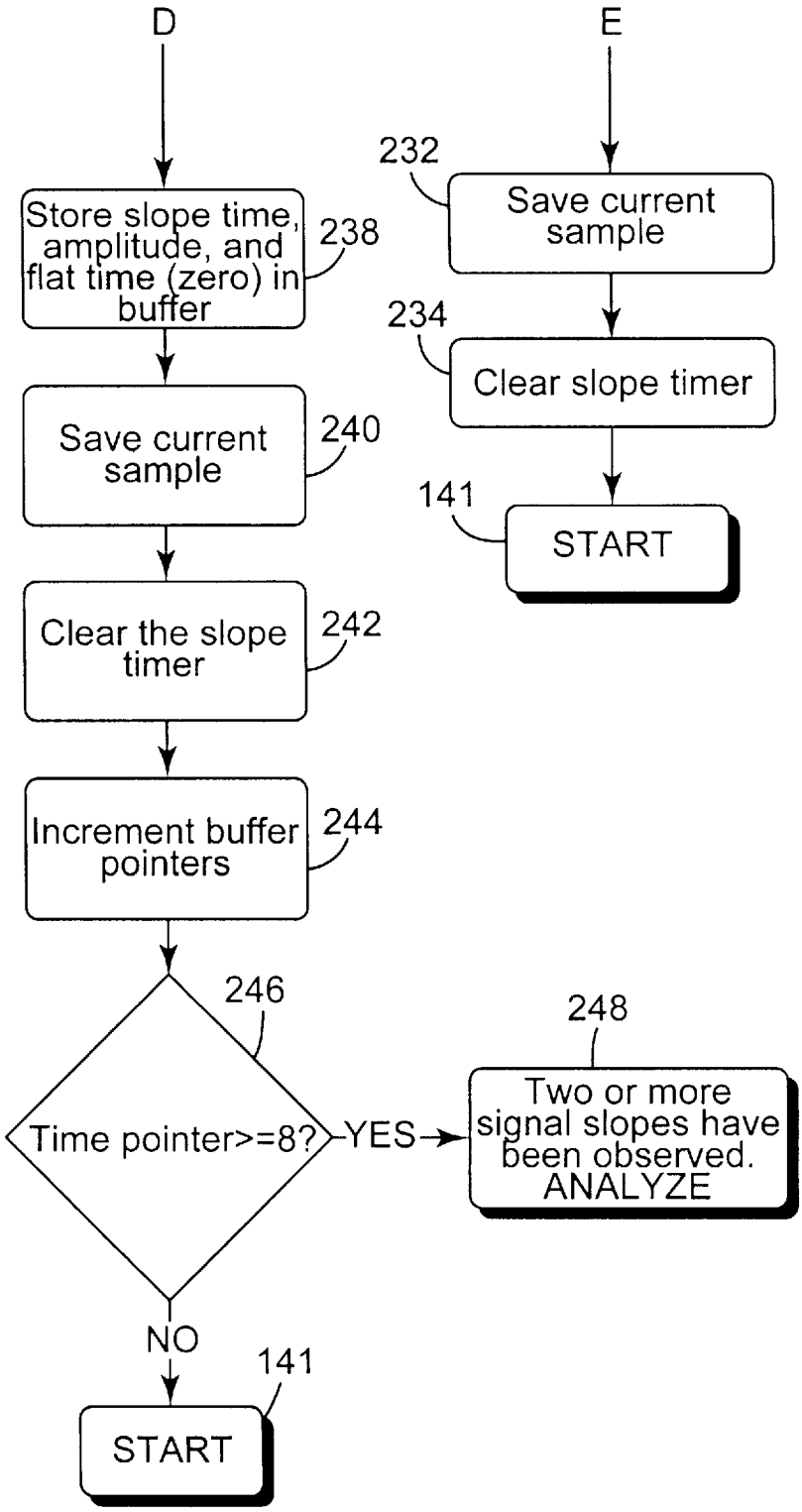

FIGS. 21*a*–21*b* illustrate the negative slope routine. The negative slope routine essentially conforms to the positive slope routine, but uses inverted polarities. Upon receipt of a sample indicating a negative slope, processor 16 increments the slope timer, as indicated by block 214 of FIG. 21*a*. If the slope timer has expired, processor 16 proceeds to the detection process initialization routine, as indicated by blocks 216, 218. If not, processor 16 determines whether the current sample is less than the previous sample, as indicated by block 220. In this manner, processor 16 determines whether the negative slope continues. If so, processor 16 saves the current sample and proceeds to the start for acquisition of the next detection signal sample, as indicated by blocks 222 and 141. With reference to blocks 224 and 226, if the current sample is equal to the last sample, processor 16 identifies a no slope condition and sets the slope flag appropriately. In addition, as indicated by blocks 228, 230, processor 16 stores the slope time between the previous and current samples and increments the buffer pointer. With reference to FIG. 21*b*, processor 16 then saves the current sample, clears the slope timer, and returns to the start of the detection process for acquisition of the next signal sample, as indicated by blocks 232, 234, 141, respectively.

With reference to block 236 of FIG. 21*a*, if the current sample is greater than the previous sample, indicating a positive slope, processor 16 sets the slope flag appropriately. As indicated by blocks 238, 240, 242, 244 of FIG. 21*b*, processor 16 then prepares for acquisition of the next sample by storing the slope time between the previous and current samples, saving the current sample in buffer 110, clearing the slope timer, and incrementing the D buffer pointer. If the time pointer is equal to or greater than 8, processor 16 proceeds to the analysis routine, as indicated by blocks 246 and 248. If not, processor 16 proceeds to the start of the detection process for acquisition of the next signal, as indicated by block 141.

Figure 22A:
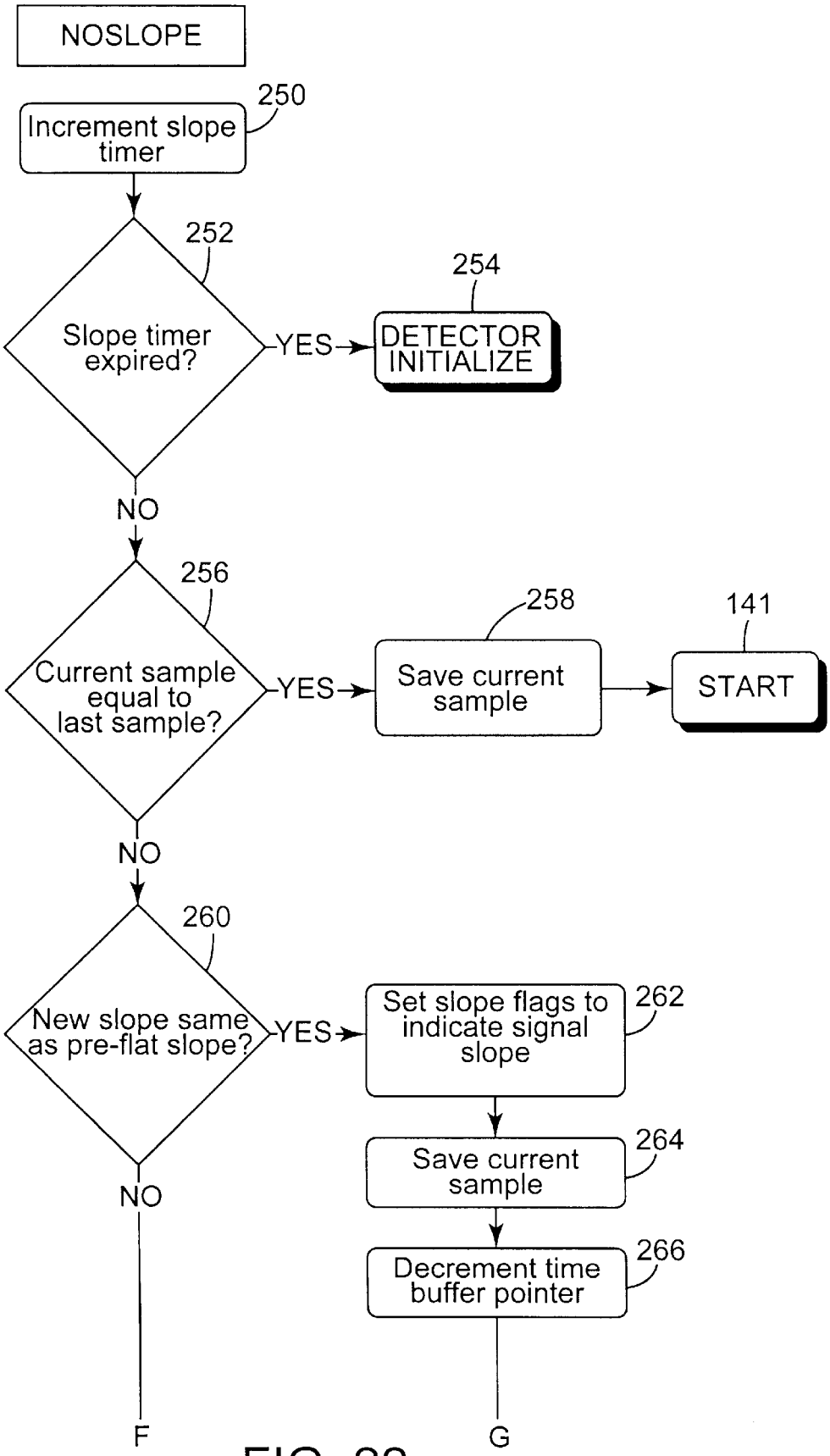
Figure 22B:
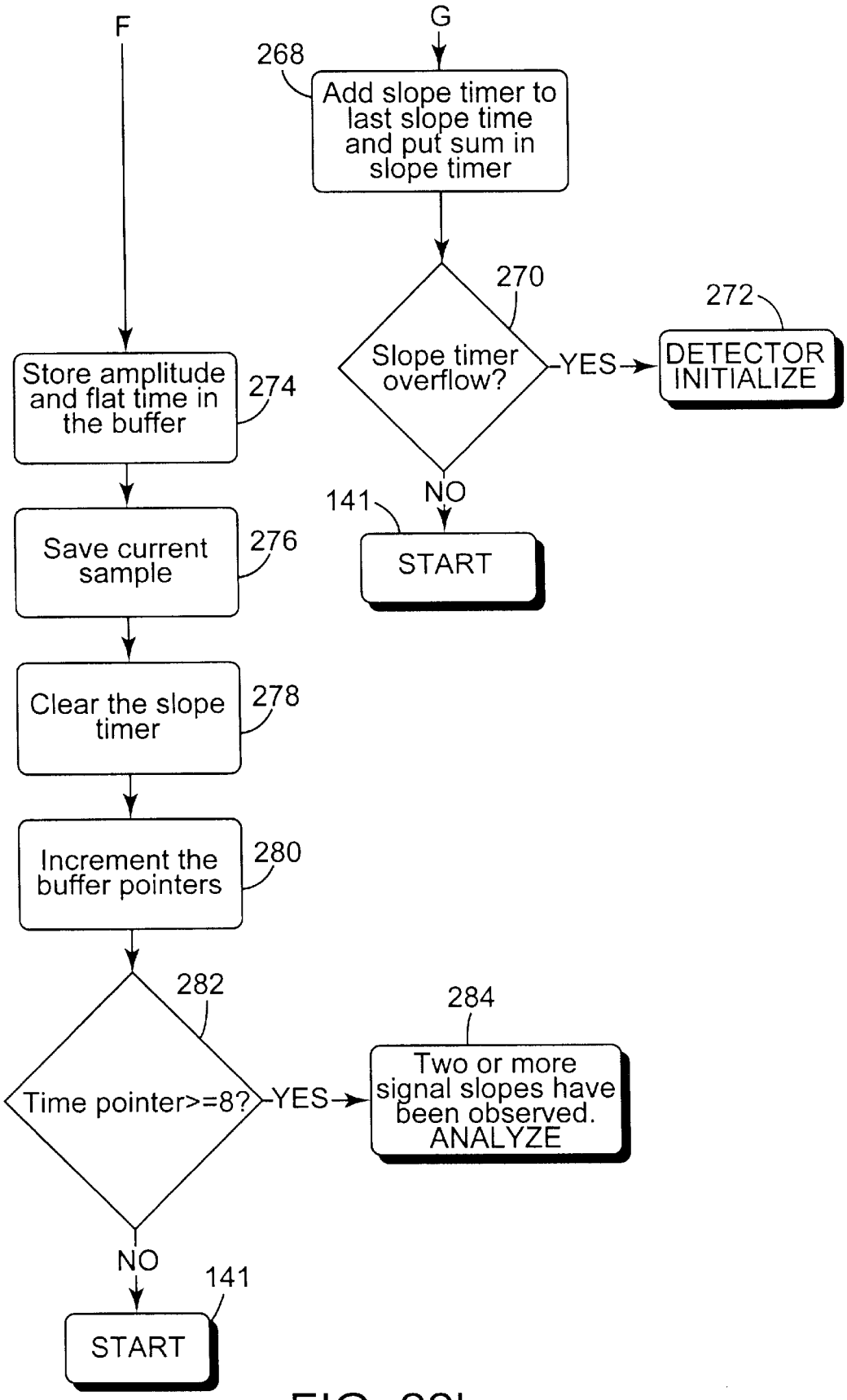

In the no slope routine illustrated in FIGS. 22*a*–22*b*, upon receipt of a sample indicating the no slope condition, processor 16 increments the slope timer, as indicated by block 250 of FIG. 22*a*. If the slope timer has expired, processor 16 proceeds to the detection process initialization routine, as indicated by blocks 252, 254. If not, processor 16 determines whether the current sample remains equal to the previous sample, as indicated by block 256. If so, processor 16 saves the current sample and proceeds to the start for acquisition of the next detection signal sample, as indicated by blocks 258 and 141. With reference to blocks 260, if the current sample is not equal to the last sample, processor 16 determines whether the new slope is the same as the last slope, i.e., positive or negative. If the slopes are the same, processor 16 sets the slope flag appropriately and saves the current sample in buffer 110, as indicated by blocks 262, 264. In addition, as indicated by blocks 266, 268 of FIGS. 22*a*–22*b*, processor 16 decrements the buffer pointer and adds the flat slope time to the previously stored slope time in buffer 110. In this manner, the algorithm effectively filters out any glitch-induced flat time in the detection signal and is able to look for a new maximum magnitude for the existing slope. If the slope timer has exceeded an applicable limit, processor 16 enters the detection process initialization routine, as indicated by blocks 270 and 272. If not, as indicated by block 141, processor 16 proceeds to the start of the detection process for acquisition of the next sample.

With further reference to FIG. 22*b*, if the slope indicated by the current sample is not the same as that prior to the flat time, processor 16 stores the amplitude of the slope, i.e., the difference between the current sample and the last slope-change sample, in buffer 110 along with the flat time as indicated by block 274. As indicated by block 276, processor 16 stores the current sample in memory 20 for reference. Processor 16 also clears the slope timer and increments the buffer pointers for acquisition of the next sample, as indicated by blocks 278, 280. If the time pointer is equal to or greater a value indicative of two slopes, processor 16 proceeds to the analysis routine, as indicated by blocks 282 and 284. If not, processor 16 proceeds to the start of the detection process for acquisition of the next signal, as indicated by block 141.

FIGS. 23*a*–23*e* illustrate the signal analysis routine of the algorithm following the acquisition of samples indicating two different slopes in the detection signal. The first slope corresponds to an increase or decrease from a reference value to a first peak value. The second slope corresponds to an increase or decrease from the first peak value to the second peak value. The first and second slope together form a "pulse." In the event the second slope is the result of a sudden glitch in the signal, as illustrated in FIG. 16, the analysis routine is capable of identifying the next peak magnitude and shifting it into the buffer location initially occupied by the glitch-induced sample. In this manner, processor effectively smooths the first and second glitch-induced slopes into a continuous first slope and proceeds to the next slope change and peak value. The details of this shifting operation will be more readily apparent from the flow diagram of FIGS. 23*a*–23*e*.

Figure 23A:
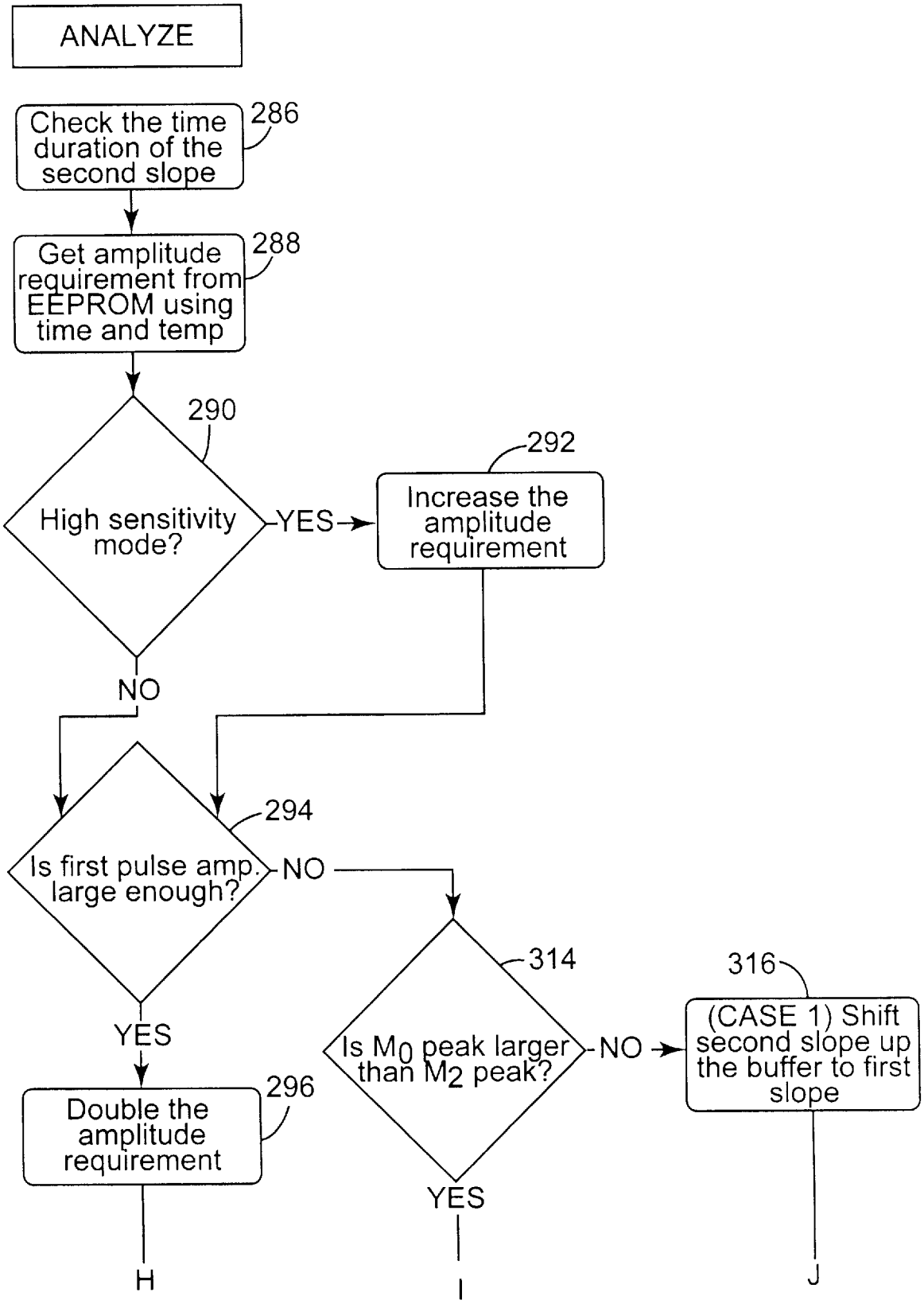

With reference to block 286 of FIG. 23*a*, upon acquiring samples indicative of two slopes in the detection signal, processor 16 first determines the time duration of the second slope by reference to the slope timer value loaded into buffer 110. As indicated by block 288, processor 16 then selects an appropriate threshold amplitude from one of the profiles in memory 20 based on the present temperature in the detection area and the signal frequency indicated by the slope time. The use of this adaptive threshold is desirable, but not necessary for practice of the algorithm detailed in FIGS. 23*a*–23*e*. Processor 16 next determines whether a high or low sensitivity mode of operation has been selected, as indicated by block 290. If a high sensitivity mode is selected, analysis of only two slope amplitudes, or one "pulse," is sufficient for triggering. Again, slope refers to the increase or decrease over a slope from a reference value to a first peak magnitude value, or from a first peak magnitude value to a second peak magnitude value. If the high sensitivity mode is selected, processor 16 increases the selected threshold amplitude by a predetermined offset as an added precaution against false triggering, as indicated by block 292. If the high sensitivity mode is not selected, the selected threshold amplitude is not changed. If the first pulse amplitude exceeds the selected threshold amplitude, plus the offset in the case of the high sensitivity mode, as indicated by block 294, processor 16 doubles the amplitude requirement, as indicated by block 296.

Figure 23B:
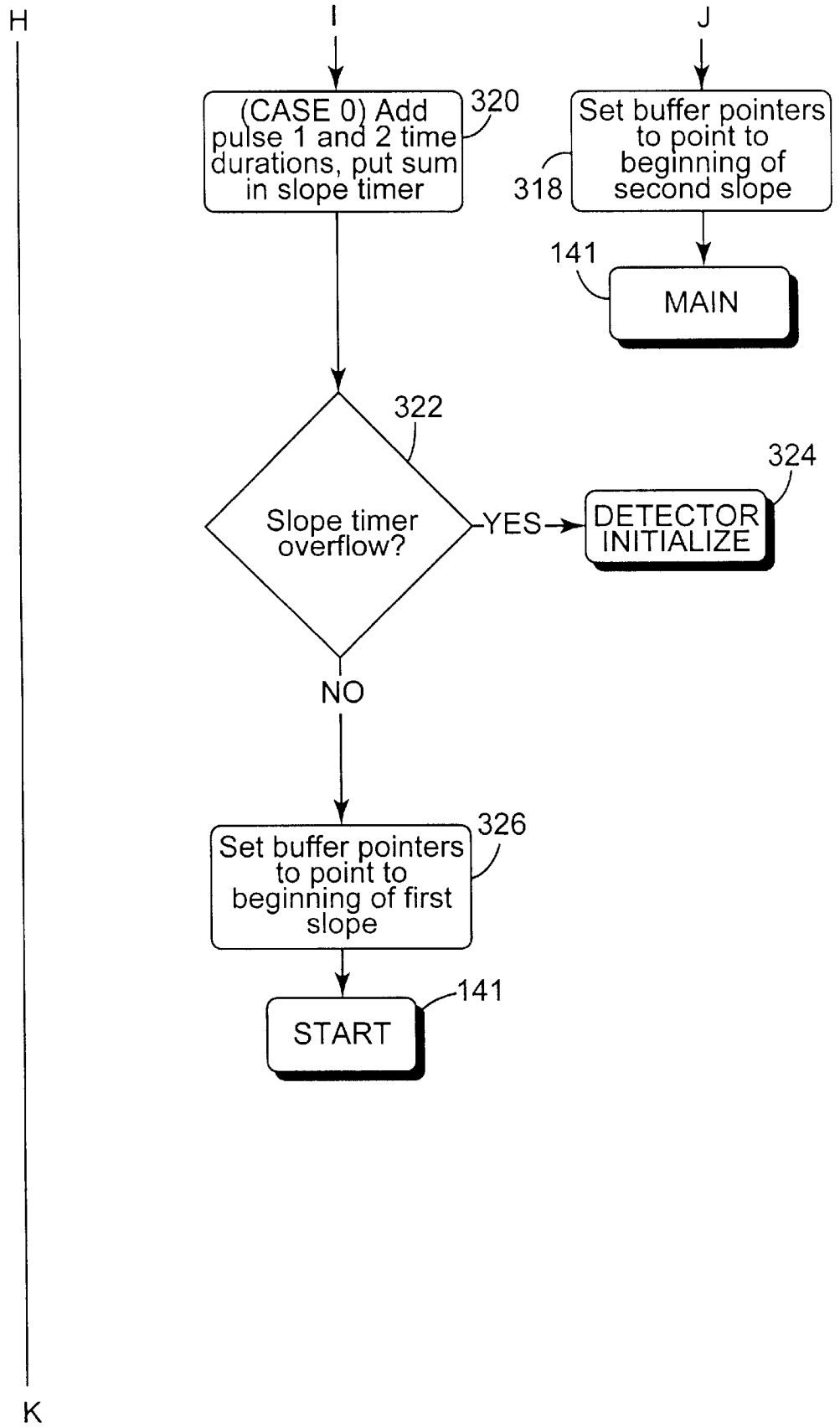
Figure 23C:
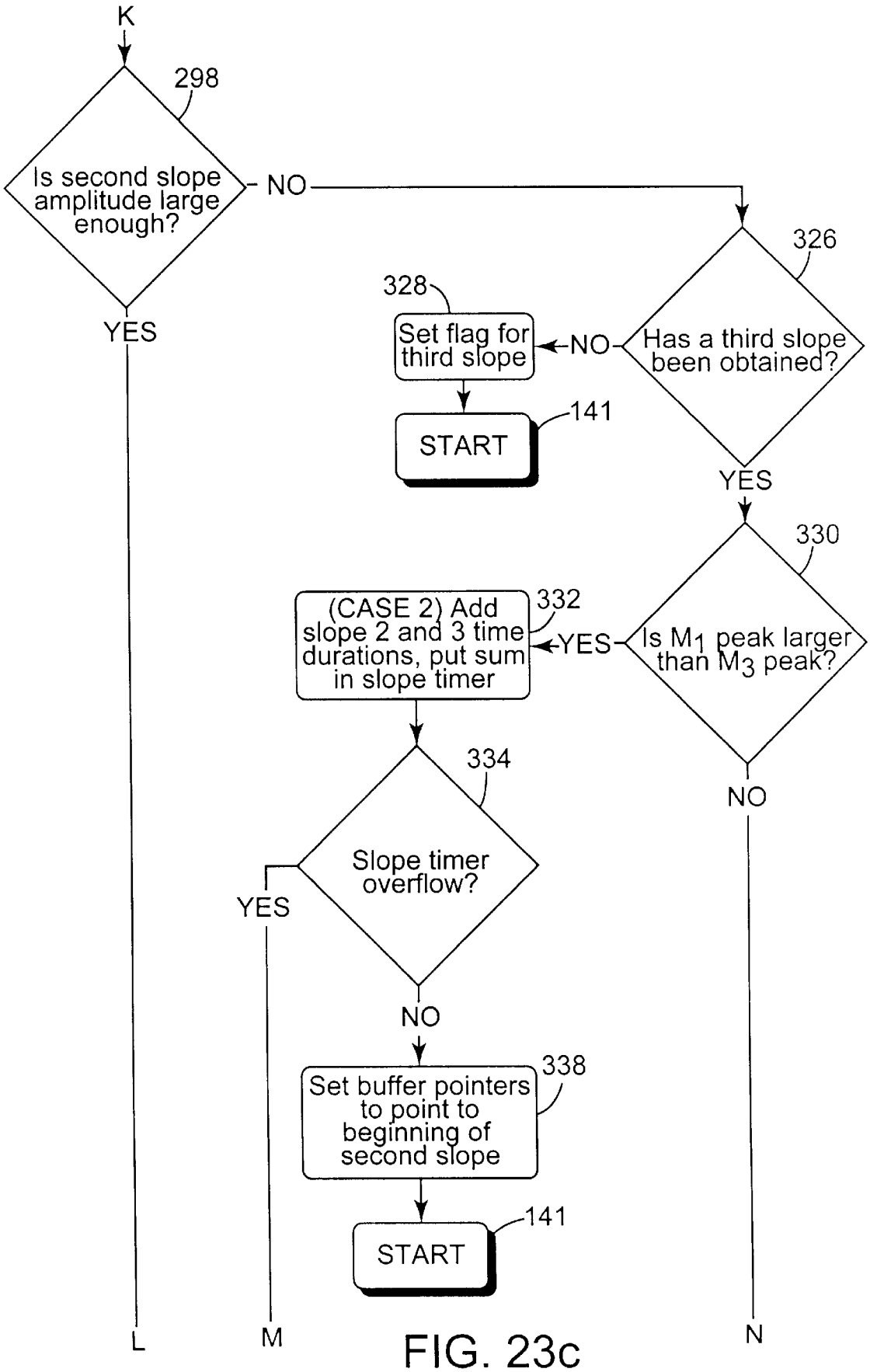

With reference to FIG. 23*b* and 23*c*, processor 16 next determines whether the second slope amplitude exceeds the doubled amplitude requirement, as indicated by block 298. If so, processor 16 compares the first pulse time to a prescribed minimum pulse duration, as indicated by block 300 of FIG. 23*d*. The minimum pulse duration is another mechanism for identifying a glitch in the detection signal. If the pulse time is sufficient and the high sensitivity mode is selected, processor 16 generates an alarm signal, as indicated by blocks 302 and 304 of FIG. 23*e*. If the pulse time is sufficient but the low sensitivity mode is selected, processor 16 seeks verification of the alarm condition by either a preceding or succeeding slope. Specifically, if a previous alarm triggering pulse is stored, as indicated by block 306, processor 16 generates the alarm signal. If not, processor 16 proceeds to acquire another slope by starting a timer between alarm pulses, as indicated by block 308, storing the current alarm-triggering pulse, as indicated by block 310, selecting the slow sampling mode, as indicated by block 312, and returning to the start of the main detection process, as indicated by block 141. The timer enables detection of an intruder that moves and stops frequently, causing time delays between alarm pulses, but provides a maximum time allowable between alarm pulses.

With reference to FIG. 23*a*, if the first slope amplitude does not exceed the applicable threshold amplitude, processor 16 determines whether the first peak $M_0$ in the buffer is larger than the third peak $M_2$ at second slope change, as indicated by block 314. This comparison is not made in an absolute sense but in a relative sense. Specifically, the comparison involves a determination of which peak, $M_0$ or $M_2$, constitutes a larger excursion from the second peak $M_1$. In other words, the amplitudes of the slopes are compared. Because peaks $M_0$ and $M_2$ are disposed at changes in opposite slopes, i.e., positive and negative, of the detection signal, it is sufficient to determine which peak is lesser in absolute magnitude in the event the first slope is positive, or which peak is greater in absolute magnitude in the event the first slope is negative. Thus, if the first slope is positive and peak $M_2$ is lesser in absolute magnitude than peak $M_0$, then peak $M_2$ is taken as larger than peak $M_0$. Conversely, if first slope is positive and peak $M_0$ is less in absolute magnitude than peak $M_2$, then peak $M_0$ is taken as larger than peak $M_2$. The end objective is to determine whether the first slope is clearly less than the threshold amplitude, as represented in the graph of FIG. 17, or whether the first slope change is the result of a glitch in the detection signal, as represented in the graph of FIG. 16. In the former case, the first slope is discarded in favor of analysis of the second slope. In the latter case, the first slope is retained and used to form a composite first slope that effectively filters out the glitch.

If the first peak $M_0$ is not larger than the third peak $M_2$ in the sense described above, processor 16 has identified one scenario (case 1) requiring buffer manipulation to alter the stored representation of the acquired signal. Specifically, in this case 1, processor 16 has determined that the first slope is clearly not part of a larger slope that may exceed the threshold. This case is represented in FIG. 17. Accordingly, as indicated by block 316 of FIG. 23*a*, processor 16 shifts the second slope of the signal into the buffer locations occupied by the first slope, eliminating the first slope from consideration. Processor 16 sets the buffer pointers to point to the beginning of the second slope for acquisition of the next sample and proceeds to the start of the detection process, as indicated by blocks 318 and 141 of FIG. 23*b*.

If the first peak $M_0$ is larger than the third peak $M_2$, processor 16 has identified another scenario (case 0). In case 0, processor 16 has determined that the second change slope is the result of a glitch and proceeds to filter out the second slope from consideration. This case is represented in FIG. 16. Specifically, as indicated by block 320, processor 16 adds the time durations of the first and second slopes and places the sum in the slope timer. If the slope timer has exceeded its limit, processor 16 proceeds to the initialization process as indicated by blocks 322, 324. If not, processor 16 sets the buffer pointers to point to the beginning of the first slope in recognition that the next slope change will indicate the beginning of the second slope and the buffer location will be incremented in the next applicable slope routine, i.e., positive, negative, or no slope, prior to storing the next buffer value. Upon acquisition of the next buffer value, it is placed in the indicated buffer location and taken as the start of the next slope change. In this way, processor 16 effectively "smooths" out the first slope by combining the times for the first, second, and third slopes, but retaining only the first and fourth magnitude peaks.

With further reference to FIG. 23*c*, if the second slope amplitude ($M_2$–$M_1$) of the stored detection signal does not exceed the selected threshold amplitude, processor 16 determines whether a third slope has been obtained, as indicated by block 326. If not, processor 16 sets the flag for the next slope, as indicated by block 328, and proceeds to the start of the signal detection process, as indicated by block 141. If a third slope has been obtained, however, processor 16 next determines whether the second peak $M_1$ is larger than the third peak $M_3$ in the relative sense described above with reference to block 314. This step is indicated by block 330. In this manner, processor 16 again is programmed to identify either a glitch-induced change in the signal or a portion of the signal that should be discarded as insignificant. If the second peak $M_1$ is larger than the third peak $M_3$, processor 16 has identified another scenario (case 2) in which the pulse under study is the result of a glitch. In case 2, as indicated by block 332, processor 16 adds the slope times from the second and third slopes and puts the resulting sum in the slope timer. If the slope timer has exceeded its limit, processor 16 proceeds to the detector initialization routine, as indicated by block 334 of FIG. 23*c* and block 336 of FIG. 23*d*. If not, processor sets the buffer points to the beginning of the second slope and returns to the start of the signal detection process, as indicated by blocks 338 and 141 of FIG. 23*c*.

Figure 23D:
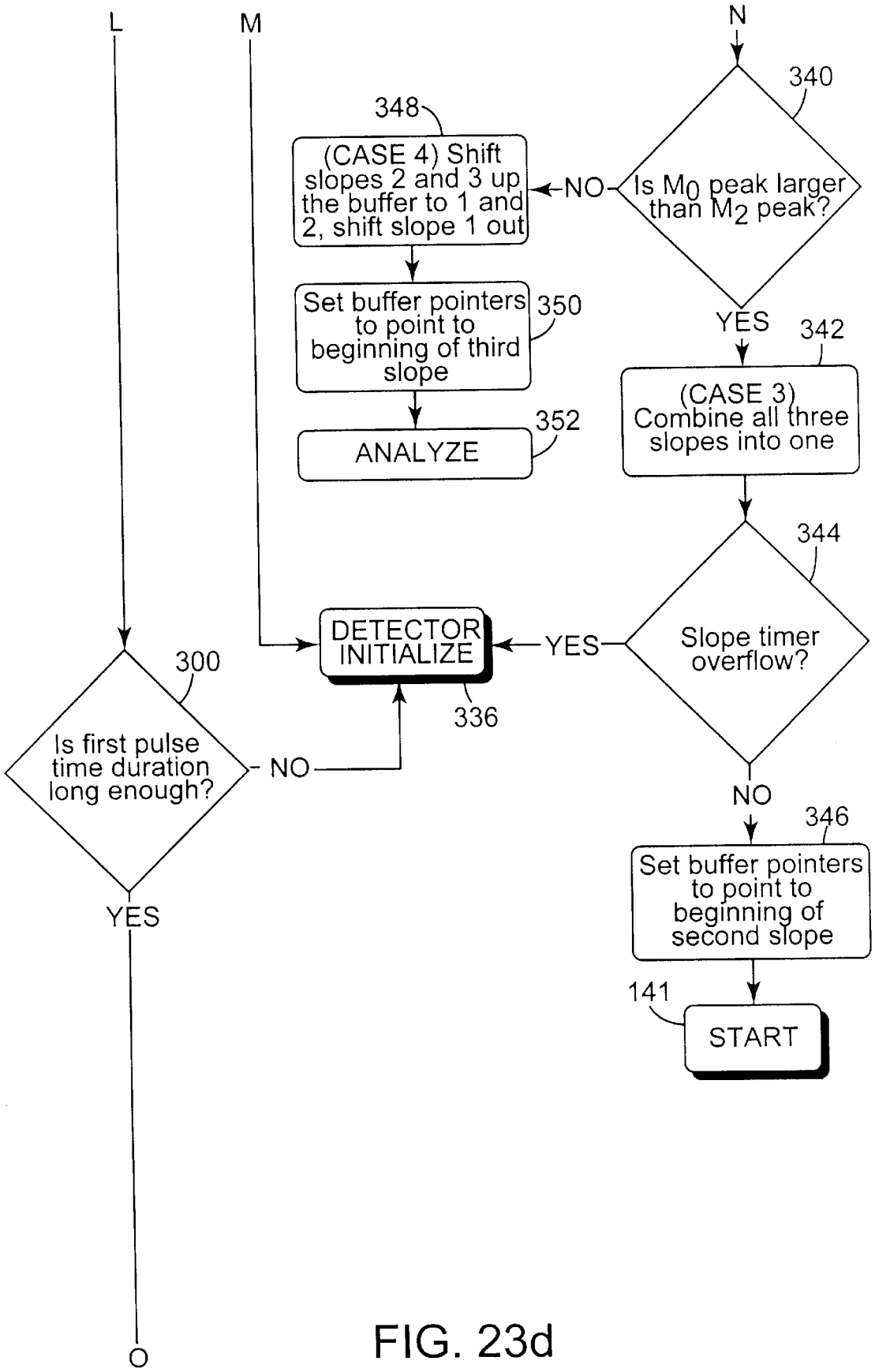
Figure 23E:
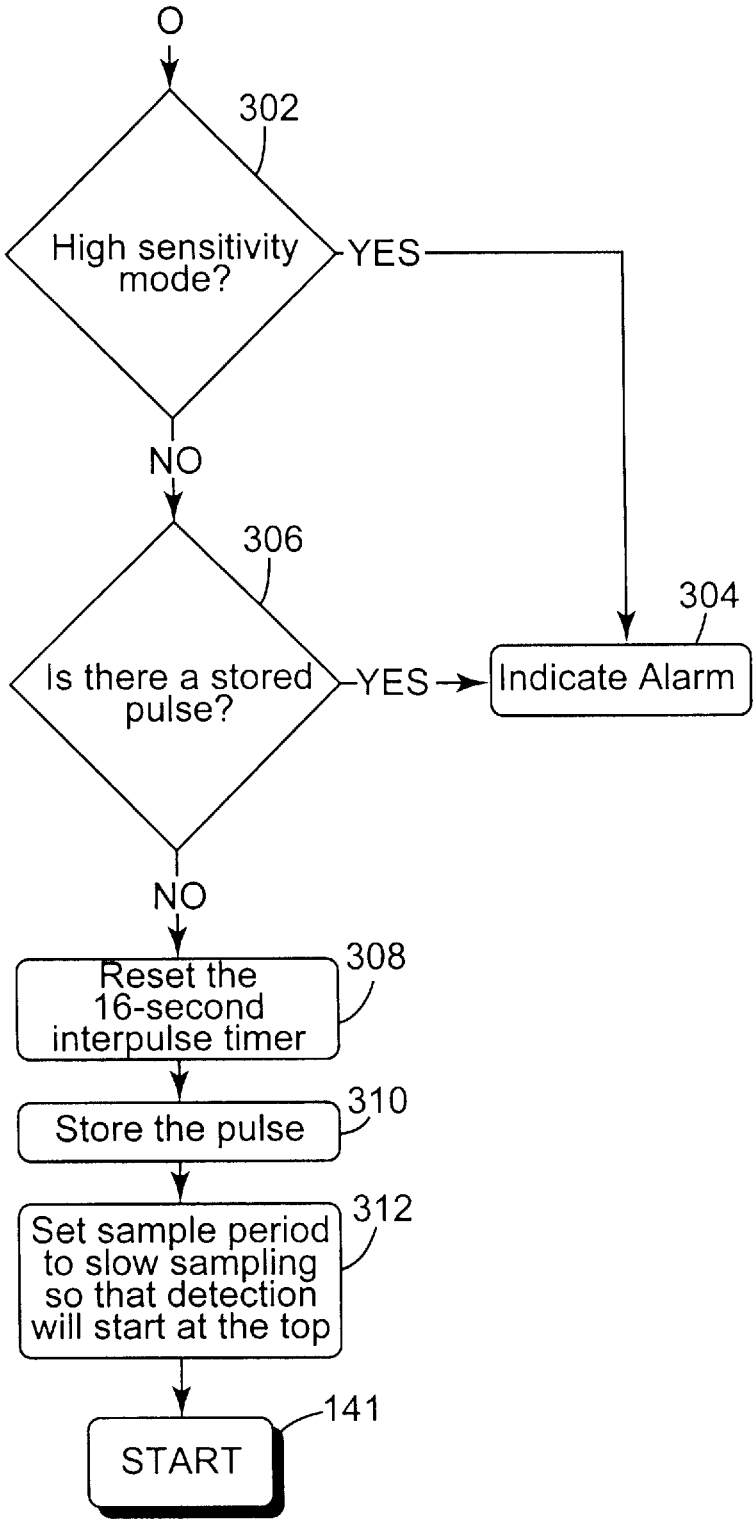

If peak $M_1$ is not larger than peak $M_3$ in the relative "excursion" sense described above with respect to blocks 314 and 330, processor 16 determines whether peak $M_0$ is larger than peak $M_2$, as indicated by block 340 of FIG. 23*d*. If so, processor 16 has identified case 3 in which a second glitch-induced change is present in the detection signal. In this case 3, processor 16 combines all of the first three slopes into a single slope by adding each of the first, second, and, third slope times together and placing the sum in the slope timer, as indicated by block 342. If the slope timer exceeds its limit, as indicated by block 344, processor 16 proceeds to the initialization process. If not, processor sets the buffer pointers to the beginning of the second slope and proceeds to the start of the detection process, as indicated by blocks 346 and 141.

If peak $M_1$ is not larger than peak $M_3$, but peak $M_0$ is not larger than peak $M_2$, processor 16 has identified case 4 in which the first slope can be discarded. In this case 4, processor 16 shifts the second and third slopes up in the buffer, eliminating the first slope, as indicated by block 348. Processor 16 then sets the buffer pointers to point to the beginning of the third slope and restarts the analysis routine, as indicated by blocks 350, 352. From this point forward, the process iterates within the analysis routine.

The foregoing detailed description has been provided for a better understanding of the invention and is for exemplary purposes only. Modifications may be apparent to those skilled in the art without deviating from the spirit and scope of the appended claims.

What is claimed is:

1. A detection system comprising:

a passive infrared sensor for generating a detection signal indicative of a level of infrared radiation within a detection area;

a processor coupled to receive the detection signal, wherein the processor is programmed to execute the steps of:

determining a peak-to-peak amplitude of the detection signal, comparing the peak-to-peak amplitude of the detection signal to a threshold amplitude, and generating, in the event the peak-to-peak amplitude is greater than the threshold amplitude, a signal indicative of the presence of the intruder within the detection area.

2. A detection method comprising the steps of:

receiving, from a passive infrared sensor, a detection signal indicative of a level of infrared radiation within a detection area;

determining a peak-to-peak amplitude of the detection signal;

comparing the peak-to-peak amplitude of the detection signal to a threshold amplitude; and indicating presence of an intruder within the detection area in the event the peak-to-peak amplitude is greater than the threshold amplitude.

3. A detection system comprising:

a passive infrared sensor for generating a detection signal indicative of a level of infrared radiation within a detection area;

a processor coupled to receive the detection signal from the infrared sensor, wherein the processor is programmed to execute the steps of:

determining a peak-to-reference amplitude of the detection signal, determining a peak-to-peak amplitude of the detection signal, comparing the peak-to-reference amplitude to a first threshold amplitude, comparing the peak-to-peak amplitude of the detection signal to a second threshold amplitude greater than the first threshold amplitude, and indicating, in the event the peak-to-reference amplitude is greater than the first threshold amplitude and the peak-to-peak amplitude is greater than the second threshold amplitude, the presence of the intruder within the detection area.

4. A detection method comprising the steps of:

receiving, from a passive infrared sensor, a detection signal indicative of a level of infrared radiation within a detection area;

determining a peak-to-reference amplitude of the detection signal;

determining a peak-to-peak amplitude of the detection signal;

comparing the peak-to-reference amplitude to a first threshold amplitude;

comparing the peak-to-peak amplitude of the detection signal to a second threshold amplitude greater than the first threshold amplitude; and indicating, in the event the peak-to-reference amplitude is greater than the first threshold amplitude and the peak-to-peak amplitude is greater than the second threshold amplitude, presence of the intruder within the detection area.

5. A detection system comprising:

a passive infrared sensor for generating a detection signal indicative of a level of infrared radiation within a detection area;

a processor operatively coupled to receive the detection signal from the infrared sensor, wherein the processor is programmed to execute the steps of:

(a) acquiring a plurality of samples of the detection signal representative of slope changes in the detection signal, (b) analyzing absolute differences between the values of successive samples to identify those samples representative of noise-induced slope changes in the detection signal, (c) discarding the identified samples, and (d) comparing the absolute differences between the values of successive remaining samples to a threshold value, and (e) indicating, in the event one or more of the absolute differences exceeds the threshold value, a condition potentially indicative of the presence of an intruder within the detection area.

* * * * *